US008977148B2

(12) United States Patent
Kaneko et al.

(10) Patent No.: US 8,977,148 B2
(45) Date of Patent: Mar. 10, 2015

(54) IMAGE FORMING APPARATUS AND IMAGE FORMING METHOD

(71) Applicants: Satoshi Kaneko, Kanagawa (JP); Jun Yamane, Kanagawa (JP); Koichi Kudo, Kanagawa (JP); Shinji Kato, Kanagawa (JP); Hitoshi Ishibashi, Kanagawa (JP); Shuji Hirai, Tokyo (JP); Shingo Suzuki, Kanagawa (JP)

(72) Inventors: Satoshi Kaneko, Kanagawa (JP); Jun Yamane, Kanagawa (JP); Koichi Kudo, Kanagawa (JP); Shinji Kato, Kanagawa (JP); Hitoshi Ishibashi, Kanagawa (JP); Shuji Hirai, Tokyo (JP); Shingo Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 72 days.

(21) Appl. No.: 13/753,859

(22) Filed: Jan. 30, 2013

(65) Prior Publication Data

US 2013/0243456 A1 Sep. 19, 2013

(30) Foreign Application Priority Data

Mar. 14, 2012 (JP) ..... 2012-057792

(51) Int. Cl.
*G03G 15/00* (2006.01)
*G03G 13/22* (2006.01)

(52) U.S. Cl.
CPC ..... *G03G 13/22* (2013.01); *G03G 15/5037* (2013.01); *G03G 15/5041* (2013.01)
USPC ..... 399/48; 399/49

(58) Field of Classification Search
CPC ..... G03G 15/5058; G03G 15/00042; G03G 2215/00075; G03G 15/5041
USPC ..... 399/48, 49, 72
See application file for complete search history.

(56) References Cited

U.S. PATENT DOCUMENTS

| | | | | |
|---|---|---|---|---|
| 2004/0100550 | A1* | 5/2004 | Bannai et al. | 347/232 |
| 2004/0253012 | A1 | 12/2004 | Ishibashi | |
| 2007/0091390 | A1* | 4/2007 | Kimura et al. | 358/500 |
| 2012/0201552 | A1 | 8/2012 | Hirai et al. | |
| 2013/0108288 | A1 | 5/2013 | Kaneko et al. | |
| 2013/0108292 | A1 | 5/2013 | Suzuki et al. | |

FOREIGN PATENT DOCUMENTS

| | | |
|---|---|---|
| JP | 62-114526 | 5/1987 |
| JP | 9-062042 | 3/1997 |
| JP | 2000-098675 | 4/2000 |
| JP | 2006-106556 | 4/2006 |

* cited by examiner

*Primary Examiner* — Gregory H Curran
(74) *Attorney, Agent, or Firm* — Oblon, McClelland, Maier & Neustadt, L.L.P.

(57) ABSTRACT

An image forming apparatus includes a rotatable image carrier that carries a toner image having a length corresponding to at least a circumferential length of the carrier; an image density detector that detects a density of the image; a potential detector that detects, over at least the circumferential length, a surface potential of the carrier before toner adheres thereto; a first image forming device that adjusts the density with a first factor, and forms an image based on a first condition of the first factor; a second image forming device that adjusts the density with a second factor, and forms an image based on a second condition of the second factor; a first determining device that determines the first condition based on uneven density; and a second determining device that determines the second condition based on uneven density and a potential distribution of the surface potential.

13 Claims, 13 Drawing Sheets

IMAGE FORMING APPARATUS AND IMAGE FORMING METHOD

CROSS-REFERENCE TO RELATED APPLICATION

This patent application is based on and claims priority pursuant to 35 U.S.C. §119 to Japanese Patent Application No. 2012-057792, filed on Mar. 14, 2012, in the Japan Patent Office, the entire disclosure of which is hereby incorporated by reference herein.

BACKGROUND OF THE INVENTION

1. Field of the Invention

The present invention relates to an image forming apparatus which forms an image with toner, such as a copier, a printer, a facsimile machine, a plotter, or a multifunction machine having at least two of the functions of these apparatuses, and to an image forming method employed by such an image forming apparatus. The present invention specifically relates to an image forming apparatus and an image forming method capable of adjusting the density of the image.

2. Description of the Related Art

A so-called electrophotographic image forming apparatus forms an image with toner. Such an image forming apparatus forms an image by causing a charging device to uniformly charge an image carrier, causing an exposure device to form a latent image on the image carrier on the basis of data input in accordance with the image to be formed, and causing a development device to make toner to adhere to the latent image.

In recent years, such image forming apparatuses have spread throughout the printing industry, and with it demand for higher output speed and higher image quality has rapidly been increasing. The demand for higher image quality includes a strong demand for density uniformity within a page, i.e., uniformity in density of an image formed on a recording medium, such as a sheet of paper. Uniform density within a page has become one criterion users use to select an image forming apparatus. It is therefore important to minimize uneven density in a page.

Uneven density is caused by various factors, such as uneven charging of the image carrier due to non-uniform charging, uneven exposure by the exposure device, uneven rotation or uneven sensitivity of the image carrier such as a photoconductor, uneven resistance of a developer carrier such as a development roller, uneven charging of toner, and uneven transfer by a transfer roller, for example. Uneven density attributed to, among other things, the uneven rotation or uneven sensitivity of the image carrier particularly occurs at relatively short intervals, and thus periodically occurs within a page and is easily noticeable. It is therefore particularly important to suppress uneven density attributed to the uneven rotation or uneven sensitivity of the image carrier.

The above-described varieties of uneven density will now be described in detail. Uneven density attributed to the uneven rotation of the image carrier will be described first. In the electrophotographic image forming apparatus, an electric field generated by the potential difference between the developer carrier and the image carrier causes toner to adhere to an outer circumferential surface of the image carrier, to thereby form an image. The uneven rotation of the image carrier, therefore, changes a development gap between the image carrier and the developer carrier, resulting in a change in the electric field and thus a change in image density.

Meanwhile, uneven density attributed to the uneven sensitivity of the image carrier occurs as follows. The sensitivity of the image carrier to the electric field, which affects the toner adhesion amount, changes in accordance with the image density. That is, the type of potential difference determining the sensitivity of the image carrier to the electric field affecting the toner adhesion amount changes in accordance with the image density, thereby changing the sensitivity of the image carrier. Specifically, in a shallow portion having a relatively high density, such as a solid image portion having a relatively large toner adhesion amount, a development potential (i.e., a potential difference between a development bias and a light potential) is dominant. Meanwhile, in a halftone or highlighted image portion smaller in toner adhesion amount than the shallow portion, a background potential (i.e., a potential difference between a development bias and a dark potential) is dominant. Herein, the light potential refers to the potential of an exposed portion of the image carrier, and the dark potential refers to the potential of a non-exposed portion of the image carrier.

If a parameter such as the development bias is controlled to correct uneven density in the shadow portion, therefore, the effect of the control is not obtained in the halftone or highlighted image portion, and uneven density is increased. For example, the development bias may be modulated in accordance with the rotation period of the image carrier, with the use of a rotational position sensor which detects the rotational position of the image carrier and a density sensor which detects the density of the image. According to this method, uneven density detected by the density sensor is divided by the rotation period of the image carrier, and the development bias is periodically changed with the use of the signal of the rotational position sensor as a trigger, such that the change of the electric field due to factors such as the uneven rotation of the image carrier is cancelled to stabilize the electric field and thereby suppress the detected uneven density.

According to this method, however, the effect of the control changes in accordance with the image density, as described above, and thus uneven density may occur in an image having a density different from the image density for which the effect of the control is expected. As previously noted, this is because the sensitivity of the image carrier to the electric field affecting toner adhesion amount changes in accordance with the image density. That is, in an image having a relatively high density, such as a density of 100%, for example, the development potential is dominant, and the modulation of the development bias results in a reduction in uneven density. Meanwhile, in an image having a relatively low density, such as a halftone or highlighted image, in which uneven density is less noticeable and the image density is affected by the background potential, the modulation of the development bias by itself causes a change in background potential, and thus may increase uneven density.

Meanwhile, streaking periodically occurring in an image may be comprehensively reduced by a method employed by an electrophotographic or electrostatic-recording image forming apparatus including a first fluctuation data storage device which previously stores periodical density fluctuation data of the image density and a first controller which controls an image forming condition on the basis of the density fluctuation data. According to this correction method, the first fluctuation data storage device stores density fluctuation data corresponding to at least one rotation period of the developer carrier, and the first controller controls one of the charging voltage, the exposure light amount, the development voltage, and the transfer voltage to correct the density in accordance with the rotation period of the image carrier. This method, however, is not free from the above-described issues.

Uneven density may be suppressed by another method focusing not on the rotation period of the image carrier but on the rotation period of the developer carrier. The method changes the development bias in accordance with the rotation period of the development roller, to thereby reduce uneven density occurring in the image with the rotation period of the development roller. Specifically, the method detects uneven density in image patterns formed on the image carrier, and performs phase matching between the detected uneven density information and the rotation of the development roller, to thereby control the development bias. If the control target is limited to the development bias, however, it is highly possible that the image density correction works in the solid image but not in the halftone image.

As a method addressing the above-described issues, the detection of uneven density may be performed with images formed at different densities, and the development bias and another image forming condition may be controlled to adjust uneven density in the images of the different densities. However, the toner consumption is increased by the formation of the images with different densities, and the load on a cleaning mechanism for cleaning off the formed images is increased. Further, the time taken for the image formation and the cleaning is increased, extending apparatus downtime.

That is, if the method of correcting uneven density due to the uneven sensitivity or uneven rotation of the image carrier involves forming a plurality of image patterns for detecting uneven density and creating correction data for image forming conditions, such as the charging bias, the development bias, and the exposure condition, to change the image forming conditions on the basis of the rotation period of the image carrier, the above-described issues arise.

For example, as the above-described method, the development bias and the charging bias may be modulated in accordance with the rotation period of the image carrier. Specifically, an uneven density detection pattern may be formed in a shadow portion to create correction data for the development bias, and then an uneven density detection pattern may be formed in a halftone portion to create correction data for the charging bias, to thereby reduce uneven density irrespective of the image density. This method also modulates the charging bias, and thus uneven density due to the control is suppressed in the halftone portion in which the background potential is dominant. This method, however, forms the two types of detection patterns described above, and thus causes the above-described increase in the toner consumption, the load on the cleaning mechanism, and the apparatus downtime.

Uneven density attributed to the uneven sensitivity of the image carrier further includes the following type. That is, if the sensitivity of the image carrier to exposure varies owing to factors such as an environmental change or overall deterioration with time, the light potential of the exposed portion of the image carrier varies, even if the image carrier is exposed with constant exposure, and causes a change in the electric field and thus a change in image density, resulting in uneven density. It is therefore preferable to also suppress uneven density due to this factor. To address the uneven sensitivity of the image carrier, a high-precision manufacturing method of the image carrier may be employed to reduce the change in sensitivity. The method, however, leads to an increase in cost, which is to be avoided as much as possible.

SUMMARY OF THE INVENTION

The present invention describes a novel image forming apparatus that, in one example, includes a rotatable image carrier, an image density detector, a potential detector, a first image forming device, a second image forming device, a first image forming condition determining device, and a second image forming condition determining device. The image carrier is configured to carry an image formed thereon with toner adhering thereto. The image has a length corresponding to at least a circumferential length of the image carrier. The image density detector is configured to detect a density of the image. The potential detector is configured to detect, over at least the circumferential length of the image carrier, a surface potential of the image carrier before the toner adheres thereto. The first image forming device is configured to adjust the density by using a first factor for forming an image, and forms an image in accordance with a first condition of the first factor. The second image forming device is configured to adjust the density by using a second factor for forming an image, and form an image in accordance with a second condition of the second factor. The first image forming condition determining device is configured to determine, on the basis of uneven density detected by the image density detector, the first condition of the first factor to adjust the density. The second image forming condition determining device is configured to determine, on the basis of uneven density and a potential distribution of the surface potential detected by the potential detector, the second condition of the second factor to adjust the density.

The second image forming condition determining device may determine the second condition such that, in an image lower in density than the image having the density detected by the image density detector, uneven density is more suppressed than in the image having the density detected by the image density detector.

The second image forming condition determining device may extract, from the potential distribution, uneven density attributed to an image density fluctuation component, and determine the second condition such that the extracted uneven density is suppressed.

The second image forming condition determining device may determine the second condition on the basis of the potential distribution and influence exerted on the density by the first condition determined by the first image forming condition determining device on the basis of uneven density.

The first image forming condition determining device may determine the first condition on the basis of uneven density such that a component of the uneven density attributable to at least a development gap fluctuation component is suppressed.

The image having the density detected by the image density detector to determine the first and second conditions may be formed under constant image forming conditions.

The first image forming device may include at least one of a development device and an exposure device.

The second image forming device may include a charging device.

In the image forming apparatus, an image forming operation may be performed to form the image having the density detected by the image density detector, and the first and second conditions may be redetermined on the basis of the detected density to perform the image forming operation in accordance with the redetermined first and second conditions.

The image forming apparatus may further include a rotational position detector configured to detect a rotational position of the image carrier. The determination of the first condition by the first image forming condition determining device, the determination of the second condition by the second image forming condition determining device, the operation of the first image forming device according to the first condition, and the operation of the second image forming device according to the second condition may be performed in synchronization with the rotational position detected by the rotational position detector.

The image forming apparatus may further include a rotational position detector configured to detect a rotational position of the image carrier. In the image forming apparatus, an image forming operation for the determination of the first condition by the first image forming condition determining device and the determination of the second condition by the second image forming condition determining device may be performed on the basis of the rotational position detected by the rotational position detector.

The first and second conditions may be determined at least one of when the number of image forming operations reaches a predetermined number, when a change in rotational position of the image carrier is expected, and when an environmental condition inside the image forming apparatus changes.

The present invention further describes a novel image forming method that, in one example, includes forming, on a rotatable image carrier, an image with toner adhering thereto, the image having a length corresponding to at least a circumferential length of the image carrier; detecting a density of the image; determining, on the basis of uneven density, a first condition of a first factor for forming an image; detecting, over at least the circumferential length of the image carrier, a surface potential of the image carrier before the toner adheres thereto; determining, on the basis of uneven density and a potential distribution of the surface potential, a second condition of a second factor for forming an image; and adjusting the density with the first and second factors, and forming an image in accordance with the first and second conditions.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
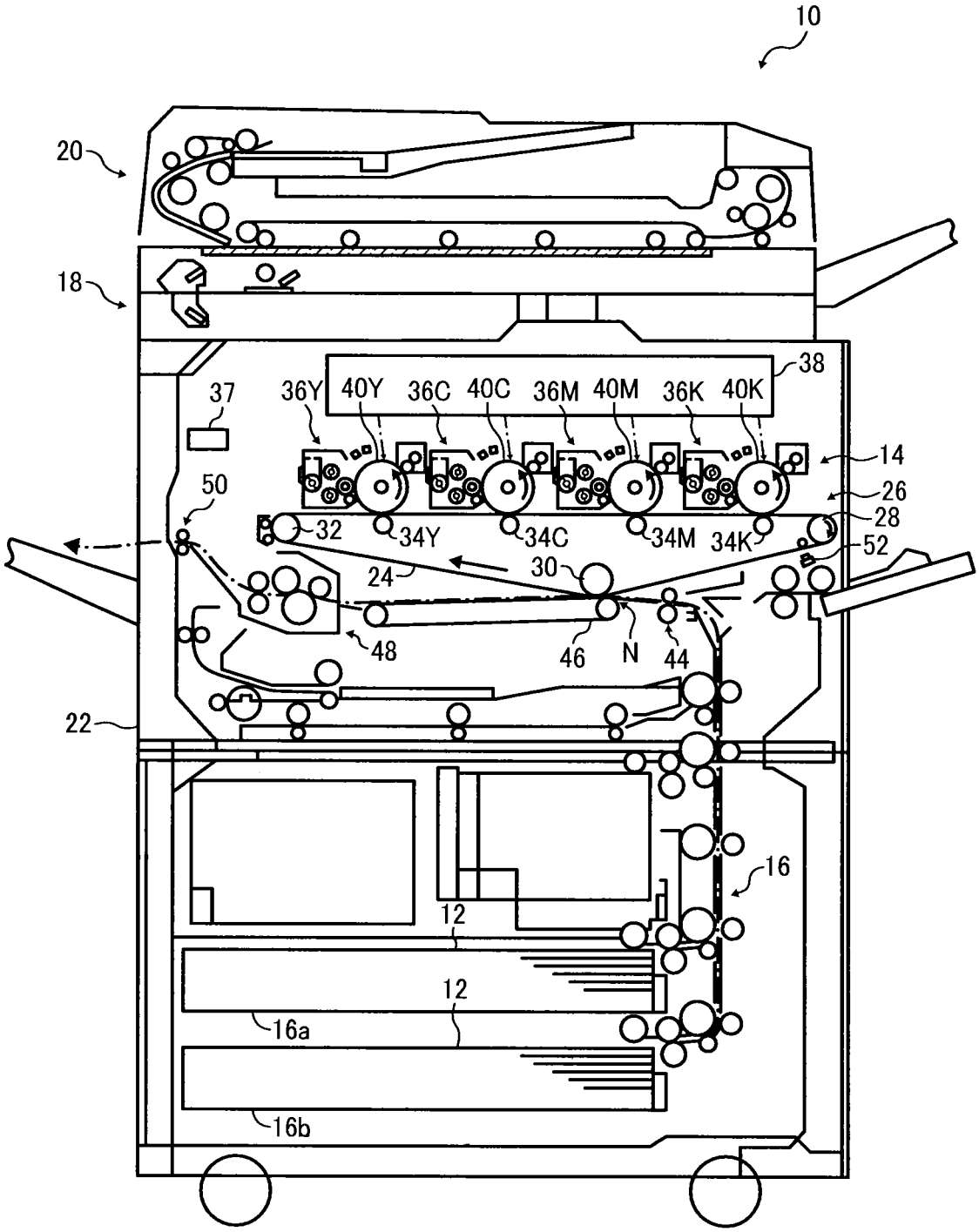
FIG. 1 is a schematic configuration diagram of an image forming apparatus according to an embodiment of the present invention.

In describing the embodiments illustrated in the drawings, specific terminology is adopted for the purpose of clarity. However, the disclosure of the present invention is not target to be limited to the specific terminology so used, and it is to be understood that substitutions for each specific element can include any technical equivalents that have the same function, operate in a similar manner, and achieve a similar result.

Figure 2:
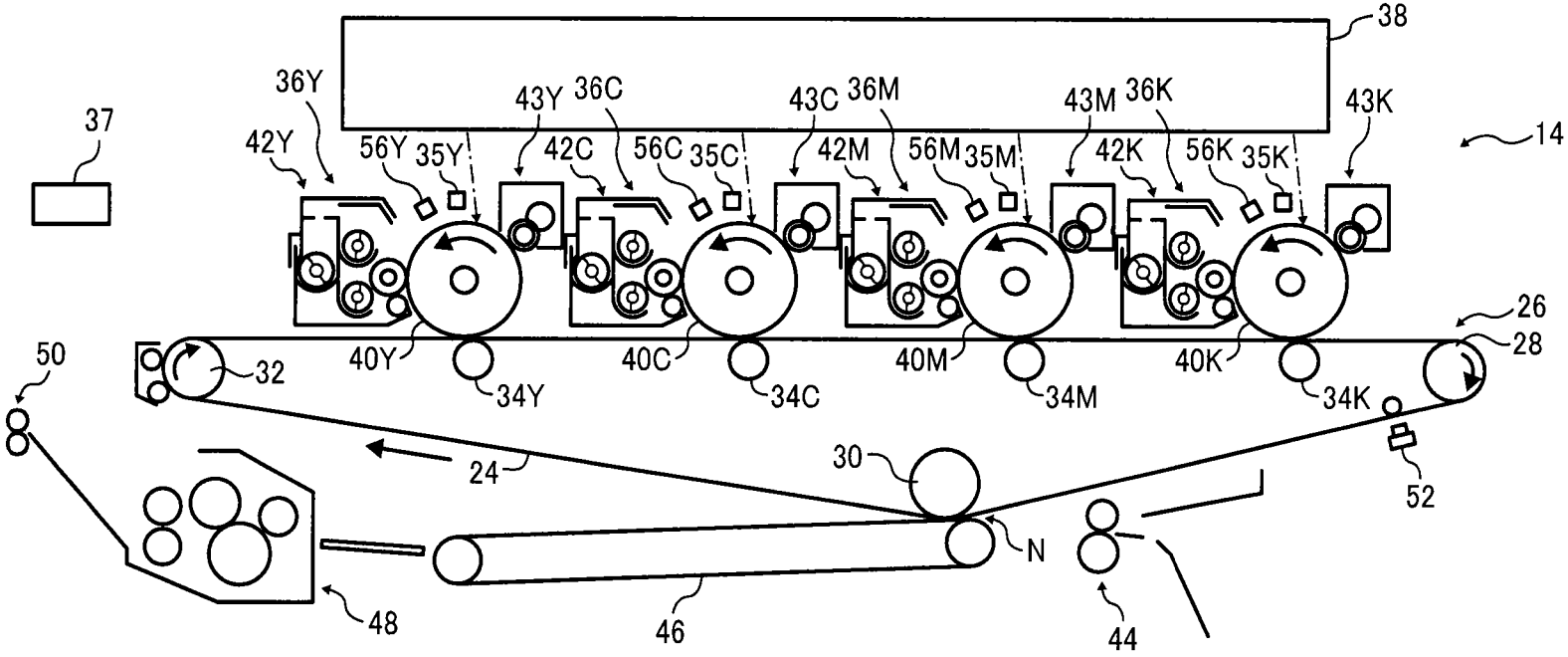
FIG. 2 is an enlarged view of an image forming unit and nearby components included in the image forming apparatus illustrated in FIG. 1.

Referring now to the drawings, wherein like reference numerals designate identical or corresponding parts throughout the several views, an embodiment of the present invention will be described. FIG. 1 is a schematic diagram of an image forming apparatus according to the present embodiment. FIG. 2 is a schematic configuration diagram of an image forming unit and nearby components included in the image forming apparatus.

As illustrated in FIG. 1, an image forming apparatus 10 includes a main unit 22, a scanner 18, and an automatic document feeder 20. The main unit 22 includes a sheet feeding unit 16, an image forming unit 14, a transfer unit 26, an optical writing unit 38, a registration roller pair 44, a feed belt 46, a fixing unit 48, a sheet discharge roller pair 50, at least one toner adhesion amount sensor 52, and a controller 37.

The sheet feeding unit 16 includes a first sheet feeding tray 16*a* and a second sheet feeding tray 16*b*, which store recording sheets 12 each serving as a recording medium. The sheet feeding unit 16 feeds a recording sheet 12 from the first sheet feeding tray 16*a* or the second sheet feeding tray 16*b* to the image forming unit 14. The image forming unit 14 includes four process units 36Y, 36C, 36M, and 36K respectively including photoconductors 40Y, 40C, 40M, and 40K (i.e., rotary members) to form an image on the recording sheet 12. The automatic document feeder 20 automatically feeds a document to the scanner 18. The scanner 18 reads the image of the document.

The transfer unit 26 serves as a transfer device which includes an endless intermediate transfer belt 24 serving as a transfer member, a drive roller 28, a secondary transfer backup roller 30, a driven roller 32, and primary transfer rollers 34Y, 34C, 34M, and 34K serving as primary transfer devices. The optical writing unit 38 serves as an exposure device located above the image forming unit 14.

The feed belt 46 is a transfer feed belt serving as a secondary transfer device which feeds the recording sheet 12 and transfers a toner image carried by the intermediate transfer belt 24 onto the recording sheet 12 at a secondary transfer position N corresponding to a nip portion formed between the feed belt 46 and the intermediate transfer belt 24. The recording sheet 12 supplied from the sheet feeding unit 16 is fed to the secondary transfer position N with predetermined timing by the registration roller pair 44.

The recording sheet 12 carrying the toner image after having passed through the secondary transfer position N is fed to the fixing unit 48 by the feed belt 46. The fixing unit 48 fixes the toner image on the recording sheet 12. The recording sheet 12 having the toner image fixed thereon passes through the fixing unit 48, and is discharged to the outside of the main unit 22 by the sheet discharge roller pair 50. In FIG. 1, a feed path in the image forming apparatus 10 for feeding the recording sheet 12 is indicated by a broken line arrow.

The toner adhesion amount sensor 52 is an uneven density detector serving as an image density detector which detects the density of the toner image on the intermediate transfer belt 24 to detect the toner adhesion amount on the intermediate transfer belt 24 and thereby detect uneven density of the image. The controller 37 is a controller including a central processing unit (CPU), a nonvolatile memory, and a volatile memory, which are not illustrated in the drawing.

As illustrated in FIG. 2, the process units 36Y, 36C, 36M, and 36K respectively include the drum-shaped photoconductors 40Y, 40C, 40M, and 40K surrounded by charging devices 43Y, 43C, 43M, and 43K, photointerrupters 35Y, 35C, 35M, and 35K, surface potential sensors 56Y, 56C, 56M, and 56K, development devices 42Y, 42C, 42M, and 42K, and the primary transfer rollers 34Y, 34C, 34M, and 34K, which are provided along the rotation direction of the photoconductors 40Y, 40C, 40M, and 40K. The photoconductors 40Y, 40C, 40M, and 40K serve as image carriers which rotate counterclockwise in FIG. 2. Each of the photointerrupters 35Y, 35C, 35M, and 35K is an image carrier rotational position detector serving as a rotational position detector which detects the rotational position (i.e., phase) of the corresponding one of the photoconductors 40Y, 40C, 40M, and 40K. Each of the surface potential sensors 56Y, 56C, 56M, and 56K serves as a potential detector which detects the surface potential of the corresponding one of the photoconductors 40Y, 40C, 40M, and 40K. The process units 36Y, 36C, 36M, and 36K form toner images of yellow, cyan, magenta, and black colors, respectively.

The development devices 42Y, 42C, 42M, and 42K are similar in configuration except for the difference in color of toner used therein. Therefore, the configuration of the development devices 42Y, 42C, 42M, and 42K will now be described with reference to FIG. 3, which illustrates the development devices 42Y, 42C, 42M and 42K as a development device 42 and the photoconductors 40Y, 40C, 40M, and 40K as a photoconductor 40. Hereinafter, the suffixes Y, C, M, and K will be omitted where color distinction is unnecessary.

Figure 3:
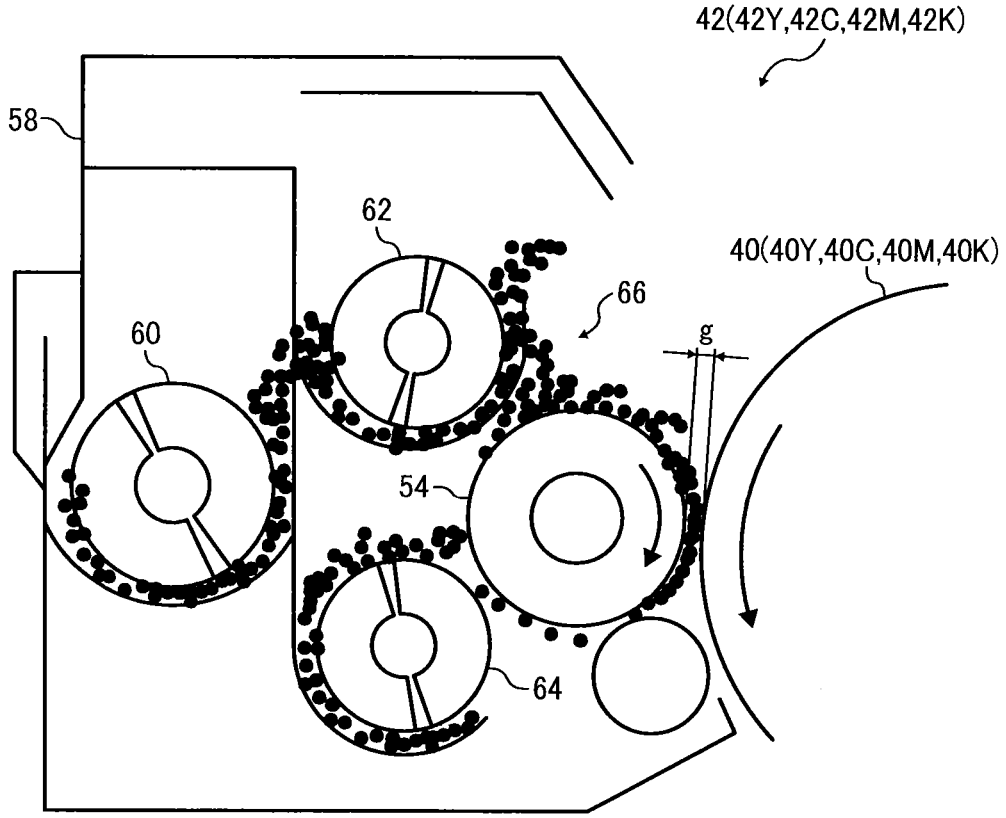
FIG. 3 is a schematic cross-sectional view of a development device included in the image forming apparatus illustrated in FIG. 1.

FIG. 3 is a schematic diagram of the development device 42. The development device 42 includes a development roller 54, three screws of a mixing screw 60, a supply screw 62, and a collection screw 64, a not-illustrated doctor blade, a development container 58, and a not-illustrated toner supply unit. The development roller 54 serves as a developer carrier. The mixing screw 60 serves as a developer mixing device. The doctor blade regulates the height of a developer 66 carried on the development roller 54. In the present embodiment, the developer 66 is a two-component powder developer including magnetic carrier and magnetic or nonmagnetic toner. The development container 58 houses the development roller 54, the mixing screw 60, the supply screw 62, the collection screw 64, and the doctor blade, and contains the developer 66. The toner supply unit supplies the toner into the development container 58 through a not-illustrated opening formed in the development container 58 above the mixing screw 60.

The development roller 54 is disposed facing the photoconductor 40 such that a development gap g having a predetermined size is formed therebetween. The mixing screw 60, the supply screw 62, and the collection screw 64 are disposed parallel to the development roller 54. The mixing screw 60 mixes and moves the developer 66 to an end portion on the proximal side in the drawing, and transports the developer 66 to the supply screw 62 through a not-illustrated opening provided in the development container 58. The developer 66 is supplied to the development roller 54 while being mixed and transported by the supply screw 62.

The height of the developer 66, i.e., the thickness of a layer of the developer 66 supplied to the development roller 54, is regulated by the doctor blade. The developer 66 comes into contact with the photoconductor 40 in a development nip facing the photoconductor 40, and the toner adheres to a latent image portion of the photoconductor 40. Thereby, the latent image portion is developed to form a toner image on the photoconductor 40. If the toner concentration in the developer 66 is reduced, the toner is supplied to the development container 58 from the toner supply unit, and is mixed by the mixing screw 60.

The present embodiment employs a single-stage forward development system in which the single development roller 54 moves in the same direction as the photoconductor 40 at the development nip. The development device 42, however, is not limited to the system, and may be a multi-stage development device including a plurality of development rollers 54. Further, the developer 66 is not limited to the two-component developer used in the present embodiment, and may be a one-component developer.

The photointerrupters 35Y, 35C, 35M, and 35K illustrated in FIG. 2 may employ, for example, the configuration disclosed in FIG. 4 of Japanese Laid-Open Patent Application No. 2000-98675. The present embodiment uses the photointerrupters 35Y, 35C, 35M, and 35K as devices for detecting the respective rotational positions of the photoconductors 40Y, 40C, 40M, and 40K. The devices, however, are not limited to the photointerrupters 35Y, 35C, 35M, and 35K, and may be any other devices capable of detecting the rotational positions, such as rotary encoders.

The surface potential sensors 56Y, 56C, 56M, and 56K detect respective potentials of electrostatic latent images written on the photoconductors 40Y, 40C, 40M, and 40K by the optical writing unit 38, i.e., respective surface potentials of the photoconductors 40Y, 40C, 40M, and 40K before the electrostatic latent images are developed by the development devices 42Y, 42C, 42M, and 42K with the toners adhering to the images.

As described later, the detected surface potentials are used to control the development bias of the development devices 42Y, 42C, 42M, and 42K, and are fed back to adjust image forming conditions, such as the charging bias of the charging devices 43Y, 43C, 43M, and 43K and the laser power of the optical writing unit 38, to maintain a stable image density.

In the transfer unit 26, the drive roller 28 driven to rotate by a not-illustrated driving device, the secondary transfer backup roller 30, and the driven roller 32 serve as a plurality of support rollers supporting the intermediate transfer belt 24. Further, the primary transfer rollers 34Y, 34C, 34M, and 34K respectively included in the process units 36Y, 36C, 36M, and 36K also serve as support rollers supporting the intermediate transfer belt 24 wound therearound. The intermediate transfer belt 24 is made of a material including a polyimide resin of relatively low elasticity dispersed with carbon powder for adjusting the electrical resistance. The intermediate transfer belt 24 is rotated clockwise in FIG. 2 with the rotation of the drive roller 28.

The optical writing unit 38 includes a not-illustrated laser controller and four not-illustrated semiconductor lasers. On the basis of image data, the laser controller drives the four semiconductor lasers to emit four beams of light for irradiating the photoconductors 40Y, 40C, 40M, and 40K uniformly charged by the charging devices 43Y, 43C, 43M, and 43K in the dark. With the beams of light, the optical writing unit 38 scans the photoconductors 40Y, 40C, 40M, and 40K in the dark, to thereby write electrostatic latent images for the yellow, cyan, magenta, and black colors on respective outer circumferential surfaces of the photoconductors 40Y, 40C, 40M, and 40K. The optical writing unit 38 thus functions as an optical writing device which exposes the photoconductors 40Y, 40C, 40M, and 40K with light to write the electrostatic latent images thereon.

The present embodiment employs, as the optical writing unit 38, a device which performs optical scanning with beams of laser light emitted from the not-illustrated semiconductor lasers, deflected by a not-illustrated polygon mirror, reflected by not-illustrated reflecting mirrors, and transmitted through not-illustrated optical lenses. Alternatively, the optical writing unit 38 may employ, in place of the above-described configuration, a configuration which performs optical scanning with a light emitting diode (LED) array.

The toner adhesion amount sensor 52 is disposed upstream of the secondary transfer position N in the rotation direction of the intermediate transfer belt 24. The toner adhesion amount sensor 52 functions as a toner image sensor which detects a toner image on the intermediate transfer belt 24.

Figure 4A:
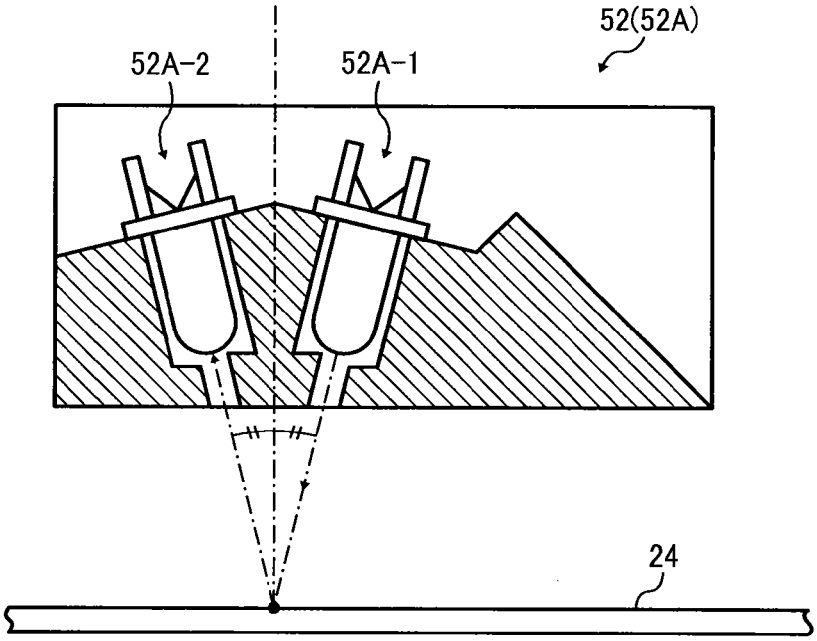
FIGS. 4A and 4B are schematic cross-sectional views each illustrating a toner adhesion amount sensor included in the image forming apparatus illustrated in FIG. 1.
Figure 4B:
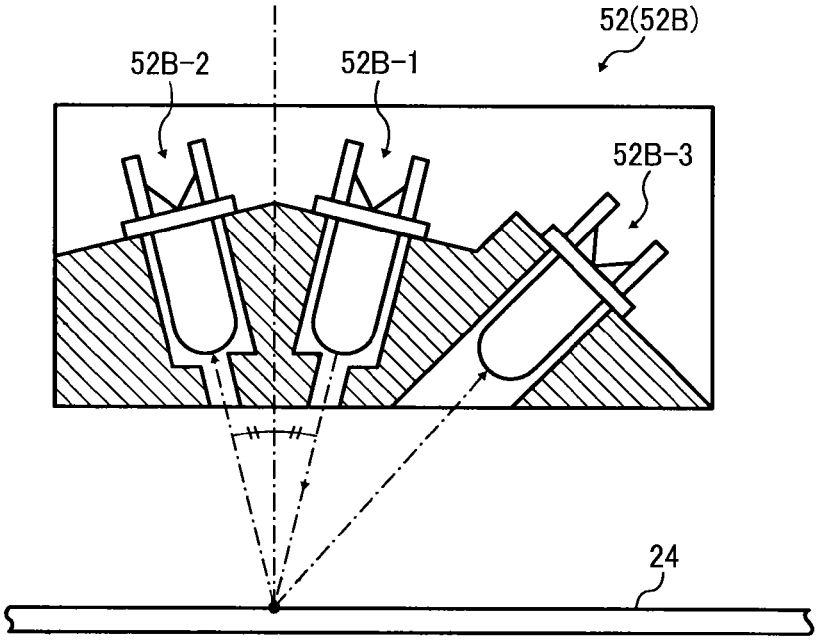

FIGS. 4A and 4B are schematic diagrams of the toner adhesion amount sensor 52. FIG. 4A illustrates a configuration of a black toner adhesion amount sensor 52A serving as the toner adhesion amount sensor 52. FIG. 4B illustrates a configuration of a color toner adhesion amount sensor 52B serving as the toner adhesion amount sensor 52. The black toner adhesion amount sensor 52A practically functions as a misregistration sensor which detects the position of the toner image on the intermediate transfer belt 24. The color toner adhesion amount sensor 52B functions as a toner adhesion amount sensor which detects the toner adhesion amount on the intermediate transfer belt 24 to detect the density of the image.

As illustrated in FIG. 4A, the black toner adhesion amount sensor 52A includes a light emitting element 52A-1 including, for example, an LED and a light receiving element 52A-2 which receives regularly reflected light. The light emitting element 52A-1 directs light onto the intermediate transfer belt 24, and the light is reflected by a surface of the intermediate transfer belt 24 or a toner image formed thereon. The light receiving element 52A-2 receives regularly reflected light included in the reflected light.

As illustrated in FIG. 4B, the color toner adhesion amount sensor 52B includes a light emitting element 52B-1 including, for example, an LED, a regularly reflected light receiving element 52B-2 which receives regularly reflected light, and a diffusely reflected light receiving element 52B-3 which receives diffusely reflected light. Similarly as in the black toner adhesion amount sensor 52A, the light emitting element 52B-1 directs light onto the intermediate transfer belt 24, and the light is reflected by the surface of the intermediate transfer belt 24 or the toner image formed thereon.

The regularly reflected light receiving element 52B-2 receives regularly reflected light included in the reflected light, and the diffusely reflected light receiving element 52B-3 receives diffusely reflected light included in the reflected light. In the present embodiment, the light emitting element 52B-1 is a gallium arsenide (GaAs) infrared light emitting diode which emits light having a peak wavelength of approximately 950 nm, and the regularly reflected light receiving element 52B-2 and the diffusely reflected light receiving element 52B-3 are silicon (Si) phototransistors having peak light receiving sensitivity of approximately 800 nm, for example. The peak wavelength and the peak light receiving sensitivity, however, may be different from those described above.

The toner adhesion amount sensor 52 is disposed facing the surface of the intermediate transfer belt 24 serving as a detection target, with the toner adhesion amount sensor 52 and the intermediate transfer belt 24 separated from each other by a detection distance of approximately 5 mm. In the present embodiment, the toner adhesion amount sensor 52 is provided near the intermediate transfer belt 24 to determine the image forming conditions on the basis of the toner adhesion amount on the intermediate transfer belt 24 and determine the timing of image formation on the basis of the toner adhesion position on the intermediate transfer belt 24. Alternatively, the toner adhesion amount sensor 52 may be provided for each of the photoconductors 40Y, 40C, 40M, and 40K to face each of the photoconductors 40Y, 40C, 40M, and 40K, or may be disposed facing, for example, the feed belt 46 to face the recording sheet 12 having images transferred thereto from the intermediate transfer belt 24.

In the controller 37, the outputs from the toner adhesion amount sensor 52 are converted into toner adhesion amounts by an adhesion amount conversion algorithm, and thereby the toner adhesion amounts are recognized and stored as image densities in the nonvolatile or volatile memory included in the controller 37. In this regard, the controller 37 functions as an image density storage device. The controller 37 functioning as the image density storage device stores the image densities as time-series data. The adhesion amount conversion algorithm employed herein is an existing algorithm, and thus description thereof will be omitted.

The nonvolatile or volatile memory of the controller 37 also stores various information of, for example, outputs from sensors such as the surface potential sensors 56Y, 56C, 56M, and 56K and the photointerrupters 35Y, 35C, 35M, and 35K, corrections data, and control results. The controller 37 stores the surface potentials detected by the surface potential sensors 56Y, 56C, 56M, and 56K, and thus functions as a surface potential storage device. Further, the controller 37 stores the rotational positions of the photoconductors 40Y, 40C, 40M, and 40K detected by the photointerrupters 35Y, 35C, 35M, and 35K, and thus functions as a rotational position storage device. The controller 37 functioning as the surface potential storage device stores the surface potentials as time-series data.

In the thus-configured image forming apparatus 10, the electrostatic latent images are written on the photoconductors 40Y, 40C, 40M, and 40K charged by the charging devices 43Y, 43C, 43M, and 43K, and are developed with the toner of the developer in each of the development devices 42Y, 42C, 42M, and 42K adhering to the corresponding one of the photoconductors 40Y, 40C, 40M, and 40K with electrostatic adhesive force. Thereafter, the resultant toner images on the photoconductors 40Y, 40C, 40M, and 40K are sequentially superimposed on the intermediate transfer belt 24 by the primary transfer rollers 34Y, 34C, 34M, and 34K. An image formed by the superimposed images is transported with the movement of the intermediate transfer belt 24, passes a detection position of the toner adhesion amount sensor 52, and reaches the secondary transfer position N.

The recording sheet 12 is fed to the secondary transfer position N by the registration roller pair 44 with predetermined timing, and the toner images of the four color components superimposed upon one another on the intermediate transfer belt 24 are together transferred at one time onto the recording sheet 12, and the recording sheet 12 is fed by the feed belt 46. Thereafter, the recording sheet 12 passes through the fixing unit 48, and thereby the toner images are fixed on the recording sheet 12 to form a color print image. The recording sheet 12 is then discharged outside the main unit 22 by the sheet discharge roller pair 50.

To improve the image quality, the thus-configured image forming apparatus 10 forms so-called image patterns, and adjusts, on the basis of densities of the formed image patterns, the density of the image to be formed in accordance with specification by a user.

Figure 5A:
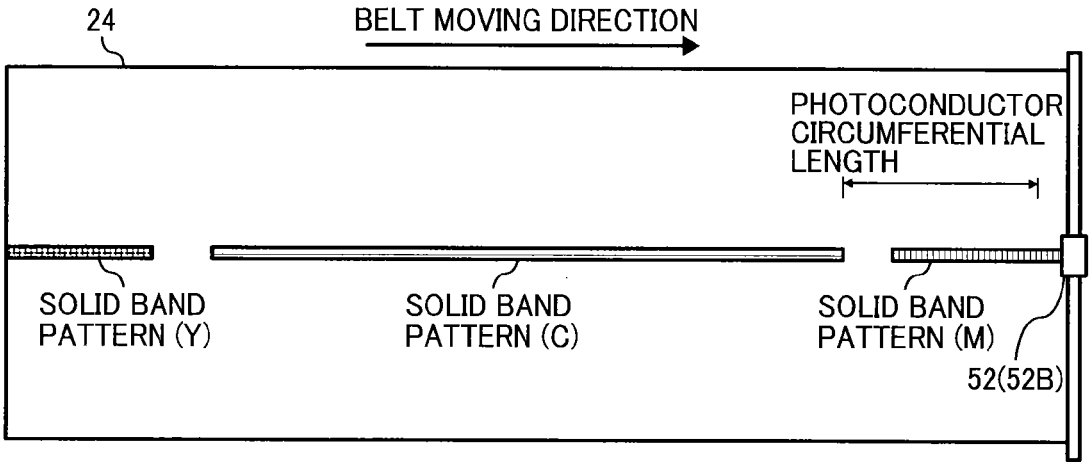
FIGS. 5A and 5B are schematic plan views each illustrating an arrangement example of the toner adhesion amount sensor illustrated in FIGS. 4A and 4B and a configuration example of images, the densities of which are detected by the toner adhesion amount sensor.
Figure 5B:
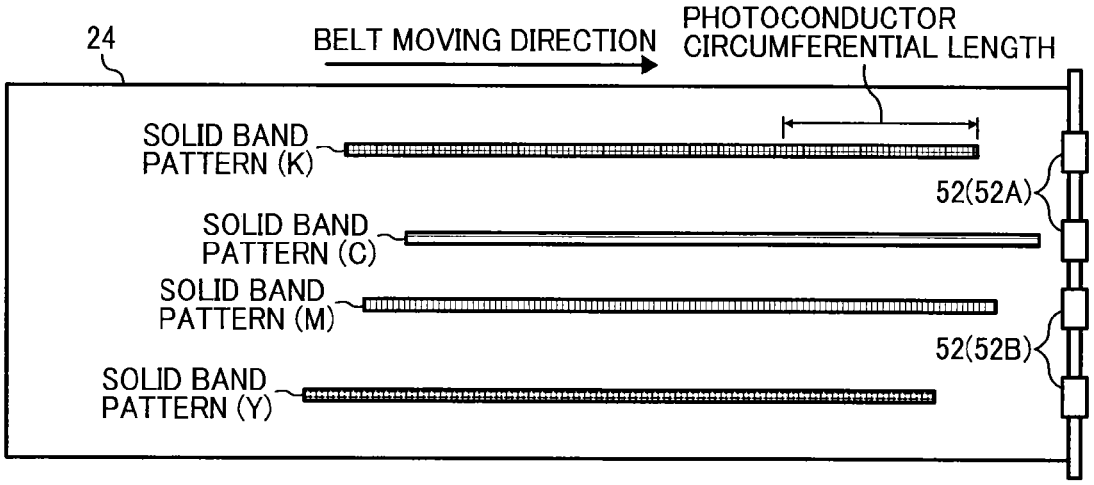

As illustrated in FIG. 5A or 5B, image patterns of the yellow, cyan, magenta, and black colors are formed into shadow portions having a relatively high density. In the present embodiment, the image patterns are formed into solid images. This is because the higher the density of the image patterns, the easier the detection of a change in image density, and because solid images are typically used as high-density image patterns. Although the image patterns are solid images in the present embodiment, the image patterns may be images lower in density than the solid images, as long as a change in image density is detectable from the images.

Each of the image patterns is formed into a band pattern elongated along a sub-scanning direction corresponding to the horizontal direction in FIG. 5A or 5B, i.e., the rotation direction of the photoconductor 40 (see FIG. 3). The length of the image pattern in the sub-scanning direction corresponds to at least the circumferential length of the photoconductor 40. In the present embodiment, the length of the image pattern in the sub-scanning direction corresponds to three times the circumferential length of the photoconductor 40.

The length of the image pattern is set as described above in order to adjust the image density in the image forming apparatus 10 to suppress uneven image density due to fluctuation in the size of the development gap between the photoconductor 40 and the development roller 54 and the uneven sensitivity of the photoconductor 40.

The above point will now be described in more detail. A cause of the change in the development gap is the uneven rotation of the photoconductor 40, and a cause of the uneven rotation is positional deviation of the rotational center of the photoconductor 40. Uneven image density due to the change in the development gap, therefore, includes a rotation fluctuation component which occurs in accordance with the rotation period of the photoconductor 40. To detect the rotation fluctuation component, the length of the image pattern in the sub-scanning direction is set to at least the circumferential length of the photoconductor 40. Further, to detect the uneven sensitivity of the photoconductor 40, it is necessary to detect the surface potential of the photoconductor 40 during the formation of the image pattern, as described later. Also for this reason, the length of the image pattern in the sub-scanning direction is set to at least the circumferential length of the photoconductor 40.

The solid band patterns of the respective colors may be formed as illustrated in FIG. 5A or FIG. 5B, for example. In FIG. 5A, the solid band patterns of the respective colors are formed at the same position in a main scanning direction corresponding to the vertical direction in the drawing, i.e., in a direction perpendicular to the sub-scanning direction. This position corresponds to a detection area of the toner adhesion amount sensor 52 in the main scanning direction. In FIG. 5A, the position corresponds to a central portion of the intermediate transfer belt 24 in the main scanning direction. However, the position is not limited thereto, and may correspond to an end portion of the intermediate transfer belt 24 in the main scanning direction. In FIG. 5B, the solid band patterns of the respective colors are formed at different positions in the main scanning direction. These positions correspond to respective detection areas of the toner adhesion amount sensors 52 in the main scanning direction.

The configuration which forms the image patterns as illustrated in FIG. 5A is advantageous in that the image densities of the image patterns are detected by the single toner adhesion amount sensor 52. The configuration which forms the image patterns as illustrated in FIG. 5B such that the image patterns of the respective colors overlap one another in the sub-scanning direction is advantageous in that the time until the completion of detection of the image densities is reduced.

As described above, the toner adhesion amount sensor 52 may be provided for each of the photoconductors 40Y, 40C, 40M, and 40K to detect the densities of the respective images formed on the photoconductors 40Y, 40C, 40M, and 40K. This configuration eliminates the influence of a change in movement of the intermediate transfer belt 24. Alternatively, as described above, the toner adhesion amount sensor 52 may be provided facing, for example, the feed belt 46 to face the recording sheet 12 having the images transferred thereto from the intermediate transfer belt 24, to detect the densities of the images formed on the recording sheet 12. This configuration also eliminates the influence of a change in movement of the intermediate transfer belt 24.

To detect the above-described component of uneven image density, image forming conditions for forming the image patterns are kept constant to form image patterns having a relatively high image density (i.e., solid image patterns in the present embodiment). Specifically, the image forming conditions correspond to factors for forming an image, such as a charging condition of the charging device 43, an exposure condition (i.e., writing condition) of the optical writing unit 38, a development condition of the development device 42, and a transfer condition of the primary transfer roller 34, for example. In the present embodiment, the charging condition includes the charging bias, the writing condition includes the intensity of the writing light, the development condition includes the development bias, and the transfer condition includes the transfer bias.

Figure 13:
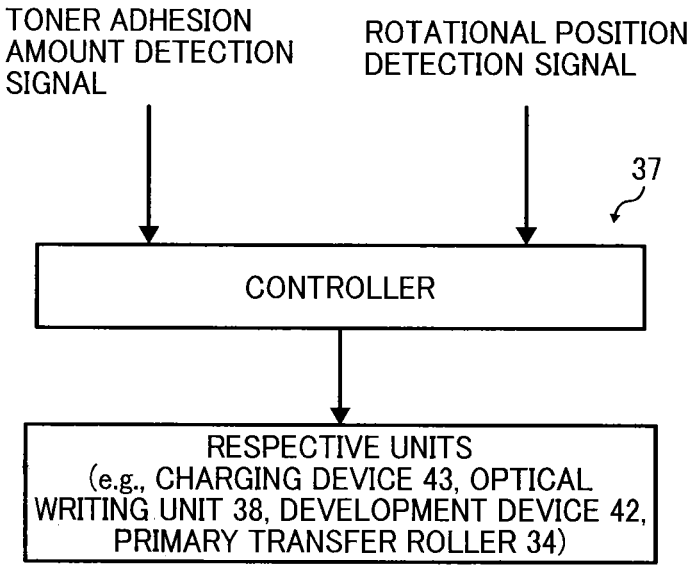
FIG. 13 is a schematic control block diagram illustrating that an image pattern is formed on the basis of the signals from the toner adhesion amount sensor and the photointerrupter.

Units such as the charging device 43, the optical writing unit 38, the development device 42, and the primary transfer roller 34 perform a series of processes of an electrophotographic image forming operation, such as development, charging, and exposure, to form the image patterns, as illustrated in FIG. 13.

If a solid image is formed under constant image forming conditions, the solid image has a uniform density, unless there is a change in the development gap or uneven sensitivity of the photoconductor 40. In reality, however, the image density is affected by, for example, the change in the development gap or the uneven sensitivity of the photoconductor 40, as described above, even if the solid image is formed under constant image forming conditions.

The change in image density is detected on the basis of the detection by the toner adhesion amount sensor 52 of the density of the solid image of the band pattern elongated in the sub-scanning direction. Specifically, detection signals of the toner adhesion amount sensor 52 are input to the controller 37 as time-series data, and the toner adhesion amounts are chronologically recognized by the controller 37 and stored as time-series image densities by the function of the image density storage device.

The controller 37 functioning as the image density storage device correlates the image densities with the phase of the photoconductor 40 on the basis of the signals of the photointerrupter 35, and averages the image densities by the rotation period of the photoconductor 40. Thereby, the controller 37 acquires and stores image density correlated with the phase of the photoconductor 40, which corresponds to later-described uneven density data f(t).

As previously noted, the image density is affected not only by the change in the development gap but also by the uneven sensitivity of the photoconductor 40. If the sensitivity of the photoconductor 40 to exposure varies owing to factors such as an environmental change or deterioration with time, the light potential of the exposed portion of the photoconductor 40 varies, even if the portion of the photoconductor 40 is exposed with constant exposure, and causes a change in electric field and thus a change in density, resulting in uneven density. To address the uneven sensitivity of the photoconductor 40, a high-precision manufacturing method of the photoconductor 40 may be employed to reduce the change in sensitivity. The method, however, leads to an increase in cost, which is to be avoided as much as possible.

Accordingly, the image forming apparatus 10 is configured to detect the uneven sensitivity by causing the surface potential sensor 56 to detect the potential of the electrostatic latent image written on the photoconductor 40 by the optical writing unit 38, i.e., the surface potential of the photoconductor 40 before the electrostatic latent image is developed by the development device 42 with the toner adhering to the image.

Specifically, the detection signals of the surface potential sensor 56 are input to the controller 37 as time-series data, and the surface potentials are chronologically recognized by the controller 37 and stored as time-series surface potentials by the surface potential storage device function.

The controller 37 functioning as the surface potential storage device then correlates the surface potentials with the phase of the photoconductor 40 on the basis of the signals of the photointerrupter 35, and averages the surface potentials by the rotation period of the photoconductor 40. Thereby, the controller 37 acquires and stores the surface potential correlated with the phase of the photoconductor 40, which corresponds to a later-described potential data Vout(t).

As described above, the image density is affected by both the change in the development gap and the uneven sensitivity of the photoconductor 40. It is therefore assumed that uneven image density is caused by superimposition of the change in the development gap on the uneven sensitivity of the photoconductor 40.

Figure 6:
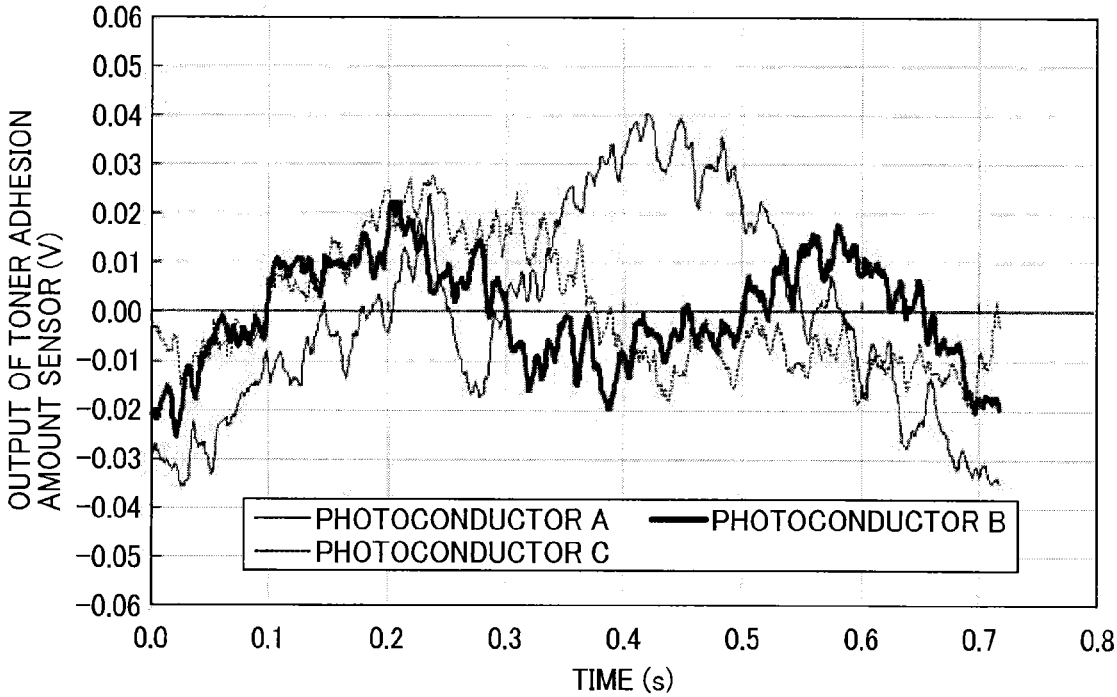
FIG. 6 is a diagram illustrating examples of uneven density.
Figure 7:
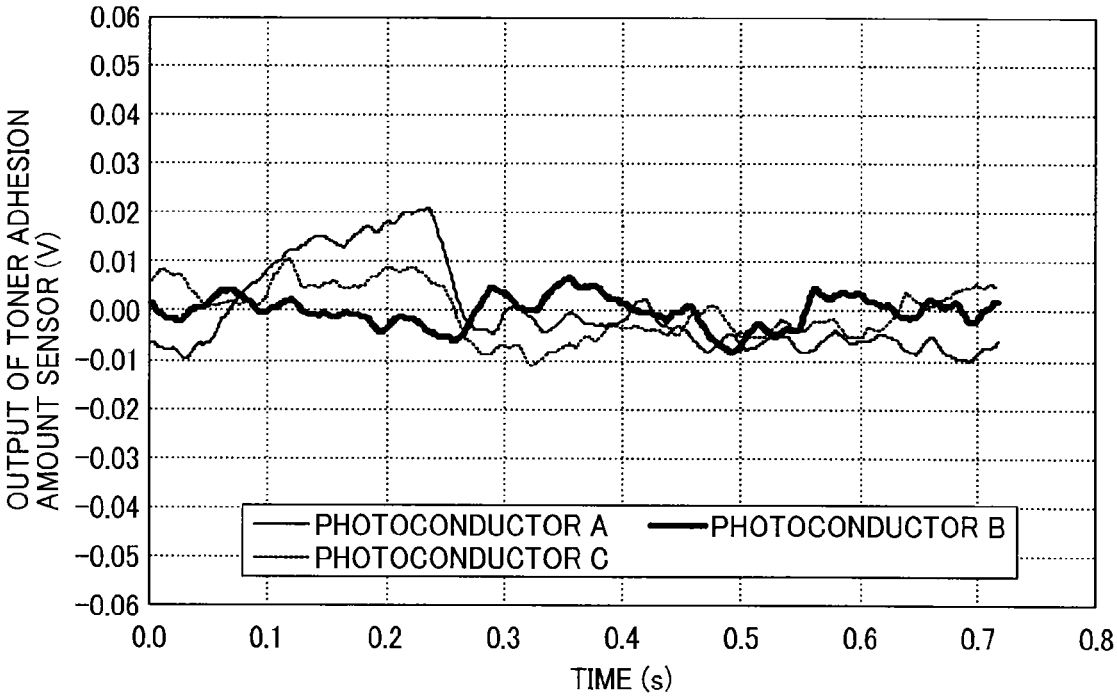
FIG. 7 is a diagram illustrating an uneven photoconductor sensitivity component of uneven density illustrated in FIG. 6.
Figure 8:
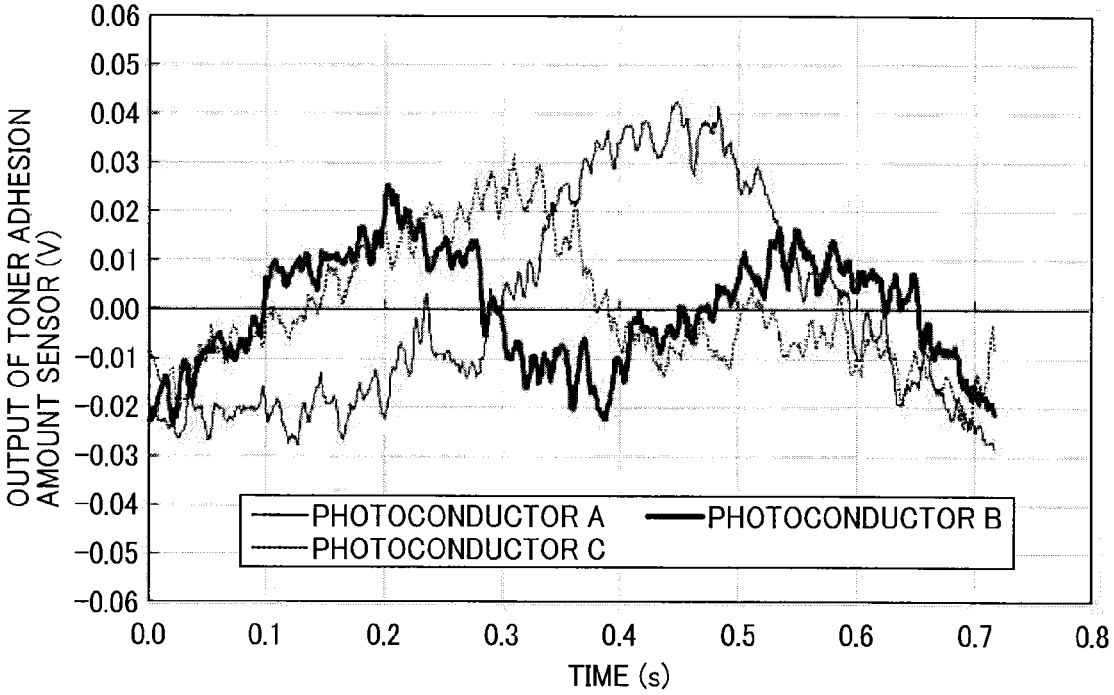
FIG. 8 is a diagram illustrating an uneven photoconductor rotation component of uneven density illustrated in FIG. 6.

This assumption will now be described with reference to the following experiment involving the above-described averaging process. FIGS. 6 to 8 illustrate data obtained by the experiment. In the present experiment, 100% cyan band patterns are formed by different photoconductors A, B, and C under the following conditions: a photoconductor diameter of approximately 100 mm, a process linear velocity of approximately 440 mm/s, a charging bias of approximately −700 V, a development bias of approximately −500V, and laser diode (LD) power corresponding to approximately 70% of the maximum light emission time per dot, and uneven density is measured in each of the band patterns.

It can be seen from FIG. 6 that the photoconductors A, B, and C have different waveforms of uneven density. Further, with the use of outputs from a potential sensor obtained during the formation of the image patterns for measuring uneven density illustrated in FIG. 6, each of the waveforms of uneven density obtained by the measurement is separated into an uneven photoconductor sensitivity component and an uneven photoconductor rotation component (i.e., an uneven development gap), which are illustrated in FIG. 7 and FIG. 8, respectively.

FIG. 7 illustrates uneven density due to uneven photoconductor sensitivity. The output of the potential sensor obtained during the formation of the band pattern having the image density of 100% is superimposed with an appropriate gain to be converted into fluctuations in output of a toner adhesion amount sensor corresponding to uneven density according to the photoconductor rotation period. The appropriate gain corresponds to a later-described first adjustment gain A.

FIG. 8 illustrates uneven density due uneven photoconductor rotation, which is calculated from the measurement data illustrated in FIG. 6 and the data illustrated in FIG. 7, and corresponds to later-described uneven density component fg(t). The component is determined by the relative positions of the photoconductor and the development roller. Therefore, the phase is not changed by the environment or over time, a point which has been confirmed by experiments conducted by the present inventors.

It is understood from a comparison of FIG. 6 and FIG. 8 that the waveform is substantially similar between FIG. 6 and FIG. 8 in all of the photoconductors A, B, and C, i.e., the uneven photoconductor rotation is a major factor causing uneven density in an image having a relatively high density. A similar comparison of FIGS. 6 and 8 with FIG. 7 indicates that, in an image having a relatively high density, the uneven photoconductor sensitivity component illustrated in FIG. 7 is a factor causing uneven density, but is less influential than the uneven photoconductor rotation component.

From the above results, it can be concluded that: (1) uneven density due to the uneven photoconductor rotation is dominant in an image of a relatively high density, and (2) the uneven photoconductor rotation component is not changed by the environment or over time. Accordingly, the present inventors have developed a correction technique of reducing uneven density in an image of a relatively high density occurring with the rotation period of the photoconductor, i.e., a control method of generating correction data according to the photoconductor rotation period from the uneven photoconductor rotation component.

If the uneven photoconductor rotation component is calculated when, for example, the photoconductor 40 is installed in the image forming apparatus 10, the present control method maintains the effect thereof, unless the state of the photoconductor 40 changes when the photoconductor 40 is detached from and reattached to the image forming apparatus 10, when the photoconductor 40 is replaced with a new photoconductor 40, when the number of image forming operations reaches a predetermined number, or when an environmental condition inside the main unit 22 is changed by, for example, a change of the environment in which the image forming apparatus 10 is used, for example. That is, if a control table for eliminating the influence of the uneven photoconductor rotation on the image density is generated when, for example, the photoconductor 40 is detached from and reattached to the image forming apparatus 10, there is no need to generate the control table on other occasions.

As described above, the factors for forming an image include the charging condition, the exposure condition, the development condition, and the transfer condition. In the present embodiment, the development condition is determined as a first factor to be controlled by the present control method, and the development device 42 serves as a first image forming device capable of adjusting the image density by using the first factor.

The development condition is selected herein as the first factor in consideration of the relatively high sensitivity thereof to the image density adjustment, particularly the image density adjustment in an image having a relatively high density, as compared with the other factors. The exposure condition is also relatively highly sensitive to the image density adjustment, and thus may replace the development condition as the first factor, or may be selected as a parameter serving as the first factor, as well as the development condition. In this case, at least one of the development device 42 and the optical writing unit 38 serves as the first image forming device.

In the execution of the above-described control, the controller 37 functions as a first image forming condition determining device which determines a specific first condition of the development condition to adjust the image density, on the basis of uneven density of the image pattern having a length corresponding to at least the circumferential length of the photoconductor 40, which is detected by the toner adhesion amount sensor 52.

The controller 37 functioning as the first image forming condition determining device detects uneven density of the image pattern through the toner adhesion amount sensor 52 in at least one of the following circumstances: when a change in rotational position of the photoconductor 40 is expected, when the number of image forming operations reaches a predetermined number, and when the environment condition inside the main unit 22 is changed by, for example, a change of the environment in which the image forming apparatus 10 is used. Then, on the basis of uneven density and a potential distribution of the surface potential detected by the surface potential sensor 56 during the formation of the image pattern, the controller 37 extracts, from the uneven image density, uneven image density attributed to the rotation fluctuation component forming a development gap fluctuation component (i.e., fluctuations in the development gap between the development roller 54 and the photoconductor 40). Thereafter, the controller 37 determines the first condition to suppress the extracted uneven image density.

The potential distribution of the surface potential over at least the circumferential length of the photoconductor 40 detected by the surface potential sensor 56 corresponds to an area for forming the image pattern to be detected by the toner adhesion amount sensor 52 in the sub-scanning direction. The controller 37 functioning as the first image forming condition determining device acquires the potential distribution in the area exposed to light to form the image pattern, and determines the first condition on the basis of calculation using the acquired potential distribution.

In the present embodiment, the first condition of the development condition (i.e., the first factor) is the development bias. The first condition, however, is not limited to the development bias, and may be any other parameter capable of adjusting the image density. Thus, if the exposure condition is determined as the first factor, exposure intensity (i.e., exposure power) may be used as the first condition. In the image formation, the development device 42 operates in accordance with the thus-determined first condition, and the operation is controlled by the controller 37. In this regard, the controller 37 functions as a first controller.

Herein, a change in rotational position of the photoconductor 40 is expected in at least one of the following circumstances: initial installation of the photoconductor 40 into the image forming apparatus 10, replacement of the photoconductor 40 with a new photoconductor 40, and detachment and reattachment of the photoconductor 40 from and to the image forming apparatus 10. The change in rotational position of the photoconductor 40 causes a change in the occurrence pattern of uneven density attributed to the change in the development gap, such as the waveforms illustrated in FIG. 8. It is therefore necessary to change a profile corresponding to the control table for controlling the image density, i.e., the development condition in the present embodiment.

That is, the determination of the image forming condition, i.e., the generation and updating of the control table is performed immediately after the photoconductor 40 is installed into the image forming apparatus 10 in, for example, initial installation, replacement, or detachment and reattachment of the photoconductor 40, because it is highly possible that mechanical removal of the photoconductor 40 from the image forming apparatus 10 changes the state of occurrence of uneven image density according to the rotation period of the photoconductor 40, because a change occurs in the relative positions of the photoconductor 40 and the photointerrupter 35 provided as a photoconductor home position sensor.

When the photoconductor 40 is initially installed into the image forming apparatus 10, the control table is not yet generated. It is therefore necessary to first generate the control table for performing a series of processes of the correction control. When the photoconductor 40 is replaced with a new photoconductor 40, the new photoconductor 40 is different from the old photoconductor 40 in terms of uneven rotation and uneven sensitivity to light. It is therefore necessary to newly generate a control table according to the new photoconductor 40. Further, when the photoconductor 40 is simply detached from and reattached to the image forming apparatus 10 for maintenance work, the detachment and reattachment of the photoconductor 40 may result in a change in the installed state of the photoconductor 40, e.g., the relative positions of the shaft and the rotation axis of the photoconductor 40. Further, a change occurs in the positional relationship between the position of uneven photoconductor rotation, the position of uneven photoconductor sensitivity, and the position of the photointerrupter 35 serving as the photoconductor home position sensor. It is therefore necessary to newly generate a control table. For the above-described reasons, it is necessary to determine the image forming condition, i.e., generate or update the control table immediately after the installation of the photoconductor 40 into the image forming apparatus 10.

As noted above, however, the image density is affected not only by the change in the development gap but also by the uneven sensitivity of the photoconductor 40 occurring when, for example, the number of image forming operations reaches a predetermined number or the environmental condition inside the main unit 22 is changed by, for example, a change in the environment in which the image forming apparatus 10 is used. That is, if the sensitivity of the photoconductor 40 to exposure varies owing to factors such as deterioration with time or an environmental change, for example, the light potential of the exposed portion of the photoconductor 40 varies, even if the photoconductor 40 is exposed with constant exposure, and causes a change in the electric field and thus a change in density, resulting in uneven density.

Accordingly, if the first condition is updated on the basis of, for example, the detection of the surface potential of the photoconductor 40 by the surface potential sensor 56 with predetermined timing after a possible change in rotational position of the photoconductor 40, such as when the number of image forming operations reaches a predetermined number, or when the environmental condition inside the main unit 22 is changed by, for example, a change in the environment in which the image forming apparatus 10 is used, uneven density due to the change in uneven photoconductor sensitivity is suppressed. The detection of the surface potential may be performed with the appropriate predetermined timing, when an image forming operation according to specification by a user is not performed, with image patterns formed in a similar manner as described above. Further, if an image formed in accordance with specification by a user includes an image of a uniform, relatively high density having a length corresponding to at least the circumferential length of the photoconductor 40, the first condition may be updated by the use of the image. The same applies to a later-described second condition.

As noted above, the uneven sensitivity of the photoconductor 40 is also caused by a change in sensitivity of the photoconductor 40 according to the image density, as well as by factors such as the deterioration with time and the environmental change, i.e., deterioration resulting from a predetermined number of image forming operations and a change in the environmental condition inside the main unit 22 due to, for example, a change in the environment in which the image forming apparatus 10 is used.

That is, the change in image density changes the type of the potential difference determining the sensitivity of the photoconductor 40 to the electric field affecting the toner adhesion amount, and thereby changes the sensitivity of the photoconductor 40. Specifically, in a shallow portion having a relatively high density, such as a solid image portion having a relatively large toner adhesion amount, the development potential (i.e., a potential difference between the development bias and the light potential of an exposed portion of the photoconductor 40) is dominant. Meanwhile, in a halftone or highlighted image portion smaller in toner adhesion amount than the shallow portion, the background potential (i.e., a potential difference between the development bias and a dark potential of a non-exposed portion of the photoconductor 40) is dominant.

As described above, in the image of a relatively high density, in which the development potential is dominant, uneven density is suppressed with the use of the first condition, such as the development bias. In the halftone or highlighted image portion, in which the background potential is dominant, the background potential is controlled with the use of a condition different from the first condition, i.e., a second condition. Among the factors for forming an image, the charging condition is effective in controlling the background potential. The present embodiment, therefore, uses the charging condition, specifically the charging bias, as the second condition. The second condition, however, is not limited to the charging bias, and may be any other parameter capable of adjusting the image density.

A description will now be given of a method of determining the second condition (i.e., the charging bias in the present embodiment) for controlling uneven density of the halftone or highlighted image portion, with reference to the results of the following experiment involving the foregoing averaging process.

Figure 9:
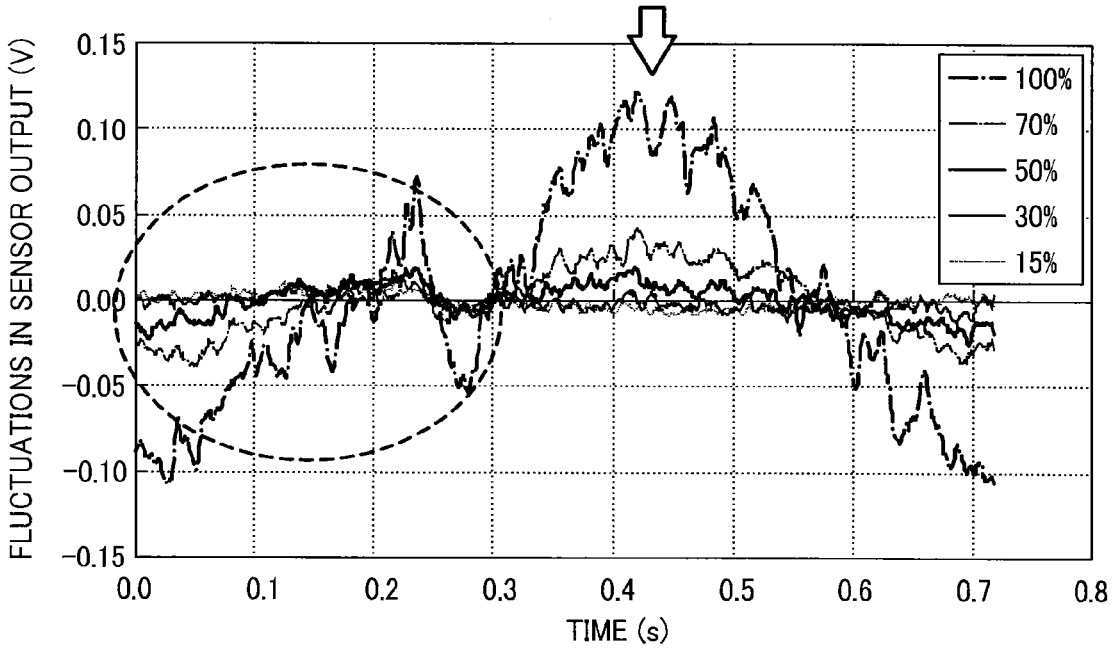
FIG. 9 is a diagram illustrating examples of uneven density corresponding to different image densities.
Figure 10:
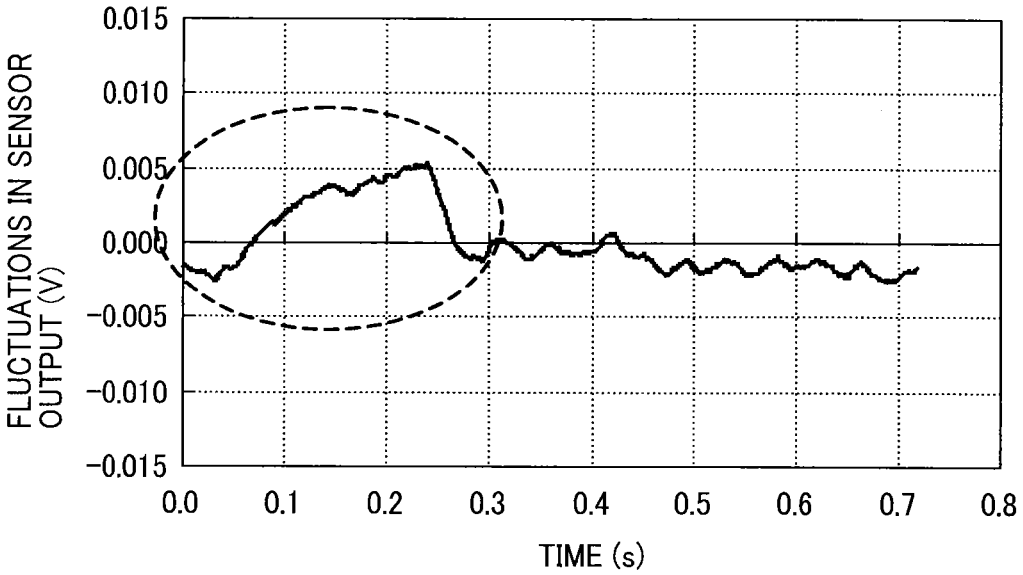
FIG. 10 is a diagram illustrating a waveform obtained from the potential of a photoconductor during the formation of an image having a relatively high density.
Figure 11:
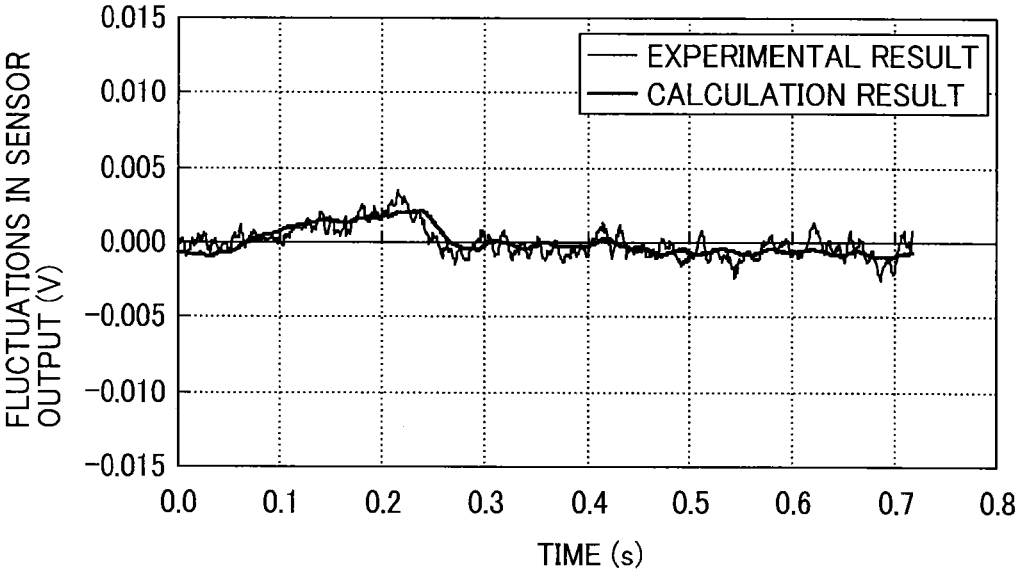
FIG. 11 is a diagram illustrating similarity between the waveform illustrated in FIG. 10 and a waveform illustrated in FIG. 9 corresponding to an image lower in density than the image corresponding to the waveform illustrated in FIG. 10.

FIGS. 9 to 11 illustrate data obtained by the experiment. In FIG. 9, a waveform indicated as 100% represents uneven density of a band pattern of a 100% cyan solid image formed under the same conditions as those of the experiment illustrated in FIG. 6. Each of the other waveforms represents uneven density of a band pattern of a cyan image having a different image density formed under the same conditions as described above except for the difference in the exposure condition.

From FIG. 9, in which uneven density is particularly noticeable in an area indicated by an arrow, it is understood that uneven density is increased in images of a relatively high density and barely appears in images of a relatively low density. In images of a relatively low density, however, uneven density occurs with different amplitudes in a range from approximately 0.1 seconds to approximately 0.3 seconds, as illustrated in an encircled area in FIG. 9. Meanwhile, uneven density of images of a relatively low density substantially disappears in a range from approximately 0.3 seconds to approximately 0.6 seconds indicated by the arrow.

The output of a potential sensor obtained during the formation of the band pattern for measuring uneven density of the 100% density solid image illustrated in FIG. 9 (i.e., later-described potential data Vout(t)) is superimposed with an appropriate gain to be converted into fluctuations in output of a toner adhesion amount sensor corresponding to uneven density according to the photoconductor rotation period occurring in the 30% density image illustrated in FIG. 9. The thus-obtained fluctuations in output of the toner adhesion amount sensor are illustrated in FIG. 10. The 30% density image is lower in density than, for example, the 50% density image. Therefore, uneven density due to the uneven photoconductor rotation is less dominant in the 30% density image than in the 50% density image.

FIG. 11 illustrates the waveform illustrated in FIG. 10 (i.e., a calculation result) and the fluctuations in output of a toner adhesion amount sensor corresponding to uneven density according to the photoconductor rotation period occurring in the 30% density image illustrated in FIG. 9 (i.e., an experimental result). As can be understood from FIG. 11, the calculation result, i.e., the waveform estimated from the output of the potential sensor, is substantially similar to the experimental result. It is therefore clear that the experimental result is reproduced by the calculation result, i.e., by the superimposition of an appropriate gain on the sensor output. That is, a component of uneven density remaining in the images of a relatively low density is a photoconductor sensitivity fluctuation component due to exposure, i.e., a photoconductor sensitivity fluctuation component due to the fluctuations in image density (i.e., an image density fluctuation component). Accordingly, the density fluctuations in the circled area in FIG. 10 are due to the change in photoconductor sensitivity corresponding to the light potential.

Therefore, the second condition may be generated by superimposing an appropriate gain on the output of the potential sensor (i.e., later-described potential data Vout(t)) obtained during the formation of the band pattern for measuring uneven density of the 100% density solid image.

Accordingly, uneven density of an image having a relatively high density is controlled by the first control using the first condition, and uneven density of a halftone or highlighted image having a lower density is controlled by the second control using the second condition. The second condition is thus used together with the first condition which changes the development potential. According to this configuration, the first condition changes the background potential, and thus it is necessary to change the second condition.

The first condition, which is dominant in an image of a relatively high density, also affects the second condition. The first condition and the second condition affect each other.

As is obvious from FIG. 9, uneven density is more easily recognized in an image of a relatively high density than in an image of a relatively low density. It is therefore preferable to first determine the first condition, and then determine the second condition in consideration of the influence of the first condition to cancel the influence.

Theoretically, it is relatively easy to estimate the influence of the first control on the halftone or highlighted image portion, if a parameter representing the influence of the first control on uneven density of the halftone or highlighted image portion is known. As obvious from the foregoing discussion, the parameter corresponds to the first condition, i.e., the development bias in the present embodiment. The level of influence of the parameter on the halftone or highlighted image portion and the amount of adjustment of the second condition to be adjusted in accordance with the influence are obtainable by calculation involving fine-tuning based on actual measurements. In this calculation, which corresponds to later-described formulae (4) and (5), later-described adjustment gains are tuned.

As described above, as to the change in uneven density according to the image density, the present inventors have found that: (1) uneven density of the halftone or highlighted image portion can be estimated from the surface potential of an image area of the photoconductor corresponding to an image of a relatively high density, and uneven density is obtainable by calculation using the surface potential, (2) the condition for controlling uneven density of the image of a relatively high density affects uneven density of the halftone or highlighted image portion, and the influence of the condition on uneven density of the halftone or highlighted image portion is obtainable by calculation, and therefore (3) the condition for controlling uneven density of the halftone or highlighted image portion is obtainable by calculation. On the basis of this reasoning, the present inventors have developed a correction technique of reducing uneven density in both an image of a relatively high density and an image of a relatively low density, i.e., a control method of generating uneven density correction data for each of the densities by forming an image pattern of a relatively high density.

Accordingly, there is no need to form the image pattern for each of the densities to reduce uneven density in an image of a relatively high density and an image of a relatively low density, reducing the toner amount consumed to form the image pattern, the time taken to form the image pattern, and the load on the cleaning mechanism.

Particularly as to the time, in a case in which the image pattern is formed for each of the image densities, an image pattern of a relatively high density is first formed to determine the first condition, and then an image pattern of a lower density is formed with the use of the first condition to determine the second condition, due to the need to take into consideration of the influence of the first condition in determining the second condition. Meanwhile, according to the present control method, there is no need to form the image pattern to determine the second condition, resulting in a substantial reduction in time taken to determine the second condition and thus a substantial reduction in apparatus downtime.

As described above, the present embodiment uses, as the second condition, the charging condition, specifically the charging bias. In the present embodiment, the charging condition is thus determined as a second factor to be controlled by the above-described control method, and the charging device 43 serves as a second image forming device capable of adjusting the image density by using the second factor.

In the execution of the control, the controller 37 functions as a second image forming condition determining device which determines the specific second condition of the charging condition to adjust the image density, on the basis of the potential distribution of the surface potential over at least the circumferential length of the photoconductor 40, which is detected by the surface potential sensor 56, and uneven density of the image pattern having a length corresponding to at least the circumferential length of the photoconductor 40, which is detected by the toner adhesion amount sensor 52.

The controller 37 functioning as the second image forming condition determining device acquires the potential distribution in the area exposed to light to form the image pattern, and determines the second condition by calculation using the acquired potential distribution. Data of the potential distribution and uneven density is also used by the controller 37 functioning as the first image forming condition determining device when determining the first condition.

As described above, the controller 37 functioning as the second image forming condition determining device determines the second condition such that, in an image lower in density than the image pattern of a relatively high density detected by the toner adhesion amount sensor 52, uneven density is more suppressed than in the image of a relatively high density.

Further, the controller 37 functioning as the second image forming condition determining device extracts, in the manner as described above with reference to FIG. 10 and other drawings, uneven density attributed to the photoconductor rotation fluctuation component from uneven density of the image pattern having a length corresponding to at least the circumferential length of the photoconductor 40, which is detected by the toner adhesion amount sensor 52. Then, the controller 37 determines the second condition to suppress the extracted uneven density.

Further, on the basis of the potential distribution and the influence exerted on the image density by the first condition determined based on uneven density by the controller 37 functioning as the first image forming condition determining device, the controller 37 functioning as the second image forming condition determining device determines the second condition to cancel the influence. In the image formation, the charging device 43 operates in accordance with the thus-determined second condition, and the operation is controlled by the controller 37. In this regard, the controller 36 functions as a second controller.

Accordingly, the controller 37 functioning as the first and second controllers operates the development device 42 in accordance with the first condition determined in the previously described manner, and operates the charging device 43 in accordance with the second condition, to thereby perform the image formation.

Figure 12:
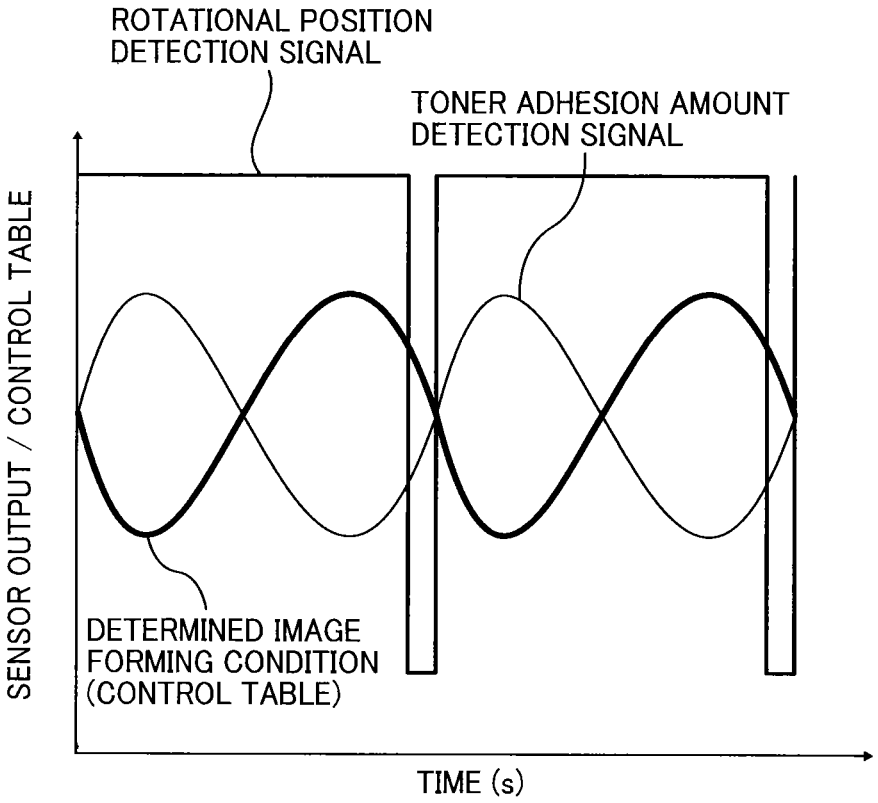
FIG. 12 is a diagram illustrating an example of the relationship between a rotational position detection signal output from a photointerrupter, a toner adhesion amount detection signal output from a toner adhesion amount sensor, and an image forming condition generated on the basis of the signals.

FIG. 12 illustrates an example of the relationship between the rotational position detection signal output from the photointerrupter 35, the toner adhesion amount detection signal output from the toner adhesion amount sensor 52, and the control table corresponding to the image forming condition generated on the basis of these signals. Each of the signals illustrated in FIG. 12 corresponds to twice the circumferential length of the photoconductor 40. In FIG. 12, the first and second conditions superimposed upon each other are indicated as a determined image forming condition, and uneven density of the image pattern is indicated as the toner adhesion amount detection signal.

As illustrated in FIG. 12, the toner adhesion amount detection signal changes with the same period as that of the rotational position detection signal. The calculation and determination of the first condition by the controller 37 functioning as the first image forming condition determining device, the calculation and determination of the second condition by the controller 37 functioning as the second image forming condition determining device, the operation of the development device 42 according to the first condition, and the operation of the charging device 43 according to the second condition are performed in synchronization with the rotational position of the photoconductor 40 detected by the photointerrupter 35.

As understood from FIG. 12, the image forming condition corresponding to the superimposition of the first and second conditions is generated as time-series data having a waveform canceling (i.e., offsetting) uneven density. Therefore, the control table corresponding to the image forming condition is determined to have an opposite phase to that of the toner adhesion amount detection signal.

Herein, if the development bias or the exposure power serving as an image density control parameter used as the first condition and the charging bias serving as an image density control parameter used as the second condition are assigned with the minus sign or increased in absolute value, the toner adhesion amount may be reduced. The expression "opposite phase" is used herein in the sense of generating a control table that cancels the change in toner adhesion amount indicated by the toner adhesion amount detection signal, i.e., generating a control table that creates a change in toner adhesion amount having the opposite phase to that of the change indicated by the toner adhesion amount detection signal.

Later-described adjustment gains for determining the control table, i.e., determining the amount of change in voltage (V) of the control table to be set relative to the amount of change in voltage (V) of the toner adhesion amount detection signal, are in principle derived from theoretical values. In reality, however, it is highly possible that gains based on the theoretical values are tested with actual devices and ultimately determined on the basis of experimental data.

The thus-determined gains determine the control table (e.g., later described conditions VB(t) and G(t)). The control table and the rotational position detection signal have the timing relationship illustrated in FIG. 12, for example. In the example illustrated in FIG. 12, the beginning of the control table corresponds to the time of generation of the rotational position detection signal.

If the control table is a development bias control table, the time of application of the control table is determined in consideration of the distance between the development nip and the toner adhesion amount sensor 52, i.e., the travel distance of the toner image from the development nip to the toner adhesion amount sensor 52. If the distance is equal to an integral multiple of the circumferential length of the photoconductor 40, the control table may be applied from the beginning in synchronization with the rotational position detection signal. If the distance is not an integral multiple of the circumferential length of the photoconductor 40, the control table may be applied with the time of application shifted by a time corresponding to the difference in distance. Similarly, if the control table is an exposure power control table, the control table is applied in consideration of the distance between the exposure position and the toner adhesion amount sensor 52. Further, if the control table is a charging bias control table, the control table is applied in consideration of the distance between the charging position and the toner adhesion amount sensor 52.

The image pattern for determining the first condition is formed on the basis of the rotational position of the photoconductor 40 detected by the photointerrupter 35. In the example illustrated in FIG. 12, the image pattern is formed such that the leading end position of the image pattern in the sub-scanning direction synchronizes with the rise of the rotational position detection signal.

To form the image pattern with the above-described timing, the detection signal indicative of the rotational position of the photoconductor 40 detected by the photointerrupter 35 is input to the controller 37 and transmitted to the respective units from the controller 37, and the units forms the image pattern on the basis of the input detection signal, as illustrated in FIG. 13.

Further, as illustrated in FIG. 13, the detection signal indicative of the density of the image pattern detected by the toner adhesion amount sensor 52 is input to the controller 37. With these input detection signals, uneven density information detected by the toner adhesion amount sensor 52 and the rotational position of the photoconductor 40 detected by the photointerrupter 35 have the relationship illustrated in FIG. 14, for example.

The CPU of the controller 37 performs an arithmetic operation on the image pattern detected by the toner adhesion amount sensor 52, specifically the foregoing averaging process based on the signal of the photointerrupter 35.

Figure 14:
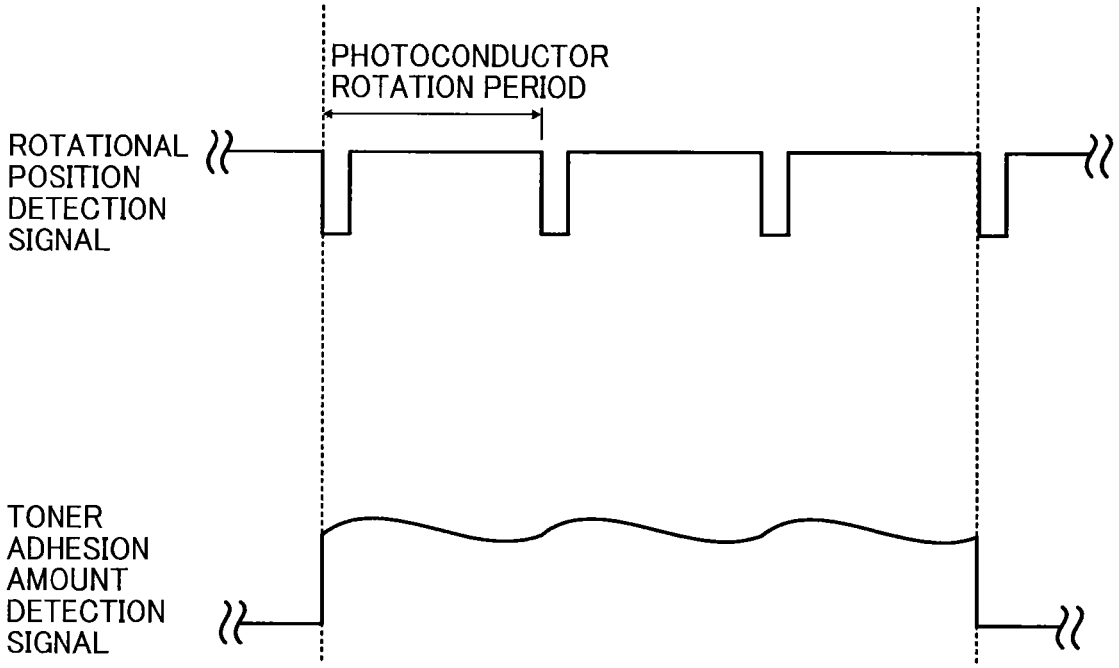
FIG. 14 is a timing chart illustrating the relationship between the signal of the toner adhesion amount sensor and the signal of the photointerrupter.

To obtain the timing relationship illustrated in FIG. 12, the present embodiment determines an image pattern writing position of the optical writing unit 38 such that the signal of the photointerrupter 35 starts at a leading end portion of the image pattern, as illustrated in FIG. 14. Specifically, the phase relationship between the toner adhesion amount sensor 52 and the photointerrupter 35 is previously obtained, and an exposure start position of the optical writing unit 38 is changed such that the detection signal of the toner adhesion amount sensor 52 starts at the leading end portion of the image pattern. The present embodiment is configured to determine the exposure start position of the optical writing unit 38 at the leading end portion of the image pattern. In the leading end portion of the image pattern, however, the toner adhesion amount may be unstable. In such a case, the exposure start position of the optical writing unit 38 may be determined such that the detection signal of the photointerrupter 35 starts at a position separated from the leading end portion by a predetermined distance at which the toner adhesion amount stabilizes.

The leading end position of the image pattern in the sub-scanning direction is determined on the basis of data of the rotational position of the photoconductor 40 detected by the photointerrupter 35, a layout distance from the exposure position to the detection position, and a process linear velocity corresponding to the layout distance. Specifically, the layout distance refers to the distance in the sub-scanning direction of an area from the wiring position (i.e., the electrostatic latent image forming position on the photoconductor 40, at which the electrostatic latent image is written by the optical wiring unit 38) to the image pattern detection position of the toner adhesion amount sensor 52, and the process linear velocity corresponding to the layout distance refers to the moving speed in the sub-scanning direction of the photoconductor 40 in the area. The above-described data is stored in the nonvolatile or volatile memory of the controller 37. In accordance with the data, the leading end position of the image pattern in the sub-scanning direction is determined.

The trailing end position of the image pattern in the sub-scanning direction may also be determined in a similar manner as in the leading end position determined as described above. Further, even if the leading end position is arbitrarily determined, the trailing end position may be determined in accordance with the above-described data.

Such determination of at least one of the leading end position and the trailing end position according to the above-described data may also be made on the basis of the time elapsed since the detection of the rotational position of the photoconductor 40 by the photointerrupter 35. Also in this case, the determination of at least one of the leading end position and the trailing end position is practically made in accordance with the above-described data. Further, in this case, the image pattern may be arbitrarily written, and an exposure end position may be determined to correspond to an integral multiple of the circumferential length of the photoconductor 40. The elapsed time may be measured by, for example, the CPU of the controller 37. In this measurement, the controller 37 functions as an elapsed time measuring device which measures the elapsed time.

The timing relationship illustrated in FIG. 12 is thus obtained, and the image pattern is formed in synchronization with the rotational position of the photoconductor 40 detected by the photointerrupter 35. Accordingly, the layout distance is different among the respective colors, and thus the image pattern forming position in the sub-scanning direction may be adjusted to be different among the process units 36Y, 36C, 36M, and 36K for the respective colors. Therefore, the image pattern forming position in the sub-scanning direction may be different among the respective colors, as illustrated in FIG. 5B.

With the above-described timing control, it is possible to accurately set the length in the sub-scanning direction of the image pattern to an integral multiple of the circumferential length of the photoconductor 40 or to the integral multiple with a slight margin required for the toner density to stabilize, for example. Accordingly, the length in the sub-scanning direction of the image pattern is set to a value necessary and sufficient for the controller 37 to determine the first condition according to the rotation period of the photoconductor 40. Consequently, it is unnecessary to provide the length in the sub-scanning direction of the image pattern with a relatively large margin corresponding to, for example, the circumferential length of the photoconductor 40, and thus the toner yield and the control time are reduced.

Specifically, the determination of the first condition by the controller 37 functioning as the first image forming condition determining device is made as follows. Uneven density component due to the uneven photoconductor rotation is first extracted from image pattern uneven density data according to the photoconductor rotation period and image pattern light potential data according to the photoconductor rotation period, as expressed by the following formulae (1) and (2):

$$fg(t)=f(t)-fv1(t) \quad (1)$$

$$fv1(t)=A*V\mathrm{out}(t) \quad (2)$$

Herein, fg(t) represents uneven density component due to the uneven photoconductor rotation, and f(t) represents the image pattern uneven density data according to the photoconductor rotation period, which is generated on the basis of the output of the toner adhesion amount sensor 52. Further, A represents the first adjustment gain, and Vout(t) represents the image pattern light potential data according to the photoconductor rotation period, which is generated on the basis of the output of the surface potential sensor 56.

Then, the first condition is calculated by the following formula (3):

$$VB(t)=B*fg(t) \quad (3)$$

Herein, VB(t) represents the first condition, and B represents the second adjustment gain.

The determination of the second condition by the controller 37 functioning as the second image forming condition determining device is made as follows. Uneven density component due to the change in photoconductor sensitivity attributed to the change in image density is first extracted from the image pattern light potential data according to the photoconductor rotation period, as expressed by the following formula (4):

$$fv2(t)=C*V\mathrm{out}(t) \quad (4)$$

Herein, fv2(*t*) represents uneven density component due to the change in photoconductor sensitivity attributed to the change in image density, and C represents the third adjustment gain. Further, Vout(t) represents the image pattern light potential data according to the photoconductor rotation period. The third adjustment gain is affected by, for example, the image area ratio.

Then, as expressed by the following formula (5), uneven density of the halftone image resulting from application of the first condition is estimated, as in the parenthesized term of the formula, on the basis of uneven density component fv2(*t*) due to the change in photoconductor sensitivity and the first condition VB(t) calculated on the basis of the image pattern uneven density data f(t) according to the photoconductor rotation period, to thereby calculate the second condition.

$$G(t)=F*(D*VB(t)+E*fv2(t)) \quad (5)$$

Herein, G(t) represents the second condition, and VB(t) represents the first condition. Further, D represents the fourth adjustment gain, E represents the fifth adjustment gain, and F represents the sixth adjustment gain.

The respective adjustment gains are tuned in accordance with the actual waveform. If the adjustment gains are affected by the usage environment of the image forming apparatus 10, such as temperature or humidity, for example, the adjustment gains may be prepared to generate a table corresponding to the usage environment, and the table may be stored in the nonvolatile or volatile memory of the controller 37 and read and used in accordance with the usage environment of the image forming apparatus 10.

As understood from the formulae (1), (2), (4), and (5), the output of the toner adhesion amount sensor 52 and the output of the surface potential sensor 56 are used in both the determination of the first condition and the determination of the second condition. Since the first condition affects the determination of the second condition, the fourth to sixth adjustment gains D, E, and F used to determine the second condition are affected by the first and second adjustment gains A and B used to determine the first condition.

Further, the present embodiment uses the output of the surface potential sensor 56 to determine the first condition, thereby controlling uneven density due to the change over time of the photoconductor 40 or the environmental change. However, if periodical uneven density due to the change in the development gap is detected by the adjustment of a gain relative to the output of the toner adhesion amount sensor 52, for example, the output of the surface potential sensor 56 is not required to determine the first condition.

Figure 15:
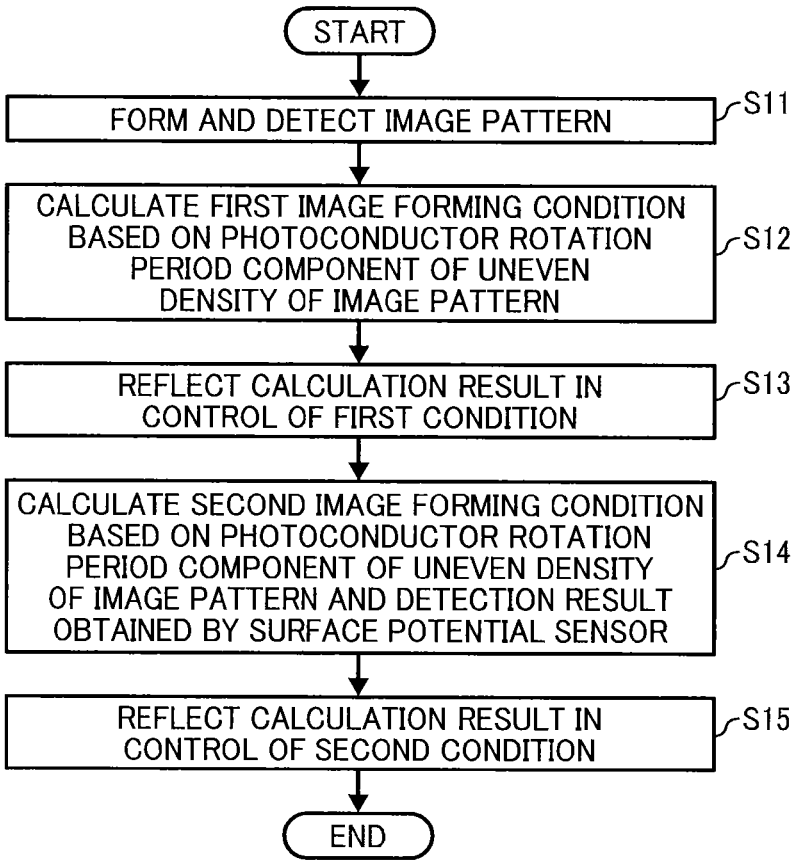
FIG. 15 is a schematic flowchart illustrating one example of control for suppressing uneven density.

An outline of the above-described control is illustrated in the flowcharts of FIGS. 15 to 18. In FIG. 15, the image pattern is first formed for each of the colors, and is detected (step S11). In this step, the light potential of the image pattern is also detected. Then, a photoconductor rotation period component of uneven density (i.e., the image pattern uneven density data f(t) according to the photoconductor rotation period)

is detected, and a first image forming condition (i.e., the first condition) is calculated (step S12), to thereby generate the control table of at least one of the development condition and the exposure condition included in the image forming conditions. The generated control table is set to be used by the controller 37 functioning as the first controller, to thereby reflect the control table in the control of the first condition (step S13). Then, on the basis of the photoconductor rotation period component of uneven density and the detection result of the surface potential sensor 56, a second image forming condition (i.e., the second condition) is calculated (step S14), to thereby generate the control table of the charging condition included in the image forming conditions. The generated control table is set to be used by the controller 37 functioning as the second controller, to thereby reflect the control table in the control of the second condition (step S15).

Figure 16:
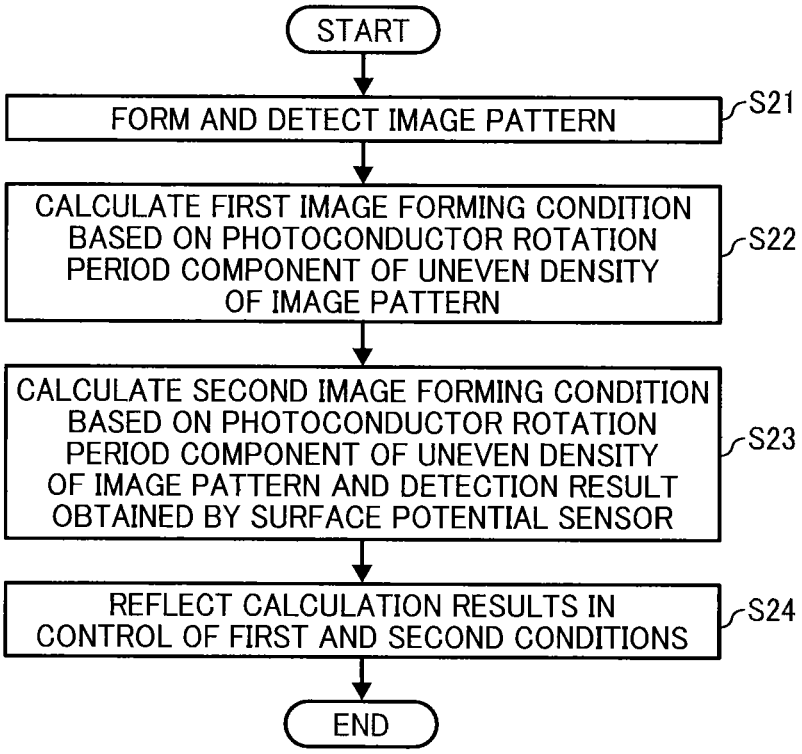
FIG. 16 is a schematic flowchart illustrating another example of control for suppressing uneven density.
Figure 17A:
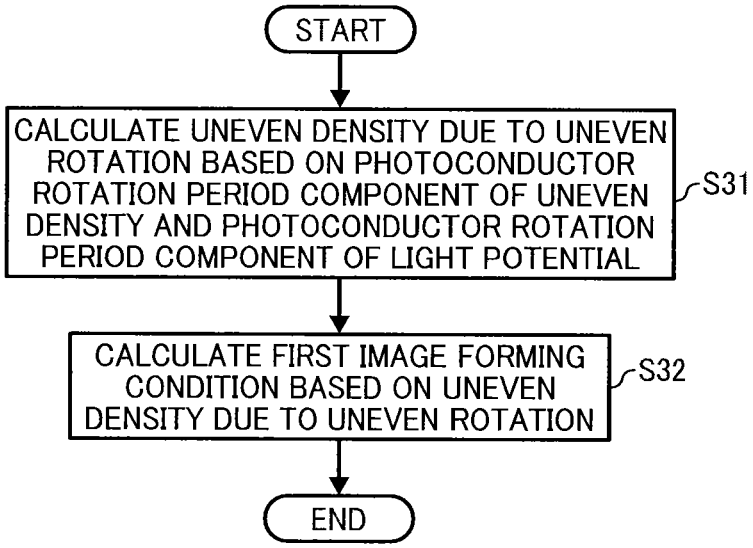
FIGS. 17A and 17B are flowcharts specifying parts of the flowcharts illustrated in FIGS. 15 and 16.

The control procedure may be modified as in FIG. 16, in which the reflection of the control table in step S13 of FIG. 15 and the reflection of the control table in step S15 of FIG. 15 take place at the same time after the calculation of the second condition in step S14 of FIG. 15. Specifically, steps S21 and S22 are performed similarly to steps S11 and S12 of FIG. 15, and then step S23 is performed similarly to step S14 of FIG. 15. Thereafter, a process similar to the processes of steps S13 and S15 of FIG. 15 is performed at step S24. Step S12 of FIG. 15 and step S22 of FIG. 16 are more specifically illustrated in FIG. 17A. In FIG. 17A, uneven density due to the uneven photoconductor rotation is first calculated on the basis of the photoconductor rotation period component of uneven density and a photoconductor rotation period component of the light potential (i.e., the image pattern light potential data Vout(t) according to the photoconductor rotation period) (step S31). Then, on the basis of the calculated uneven density, the first image forming condition is calculated (step S32).

Figure 17B:
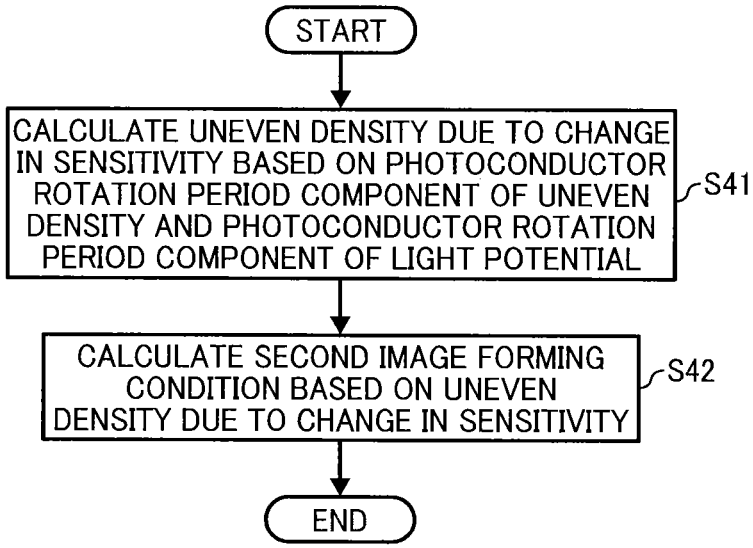

Step S14 of FIG. 15 and step S23 of FIG. 16 are more specifically illustrated in FIG. 17B. In FIG. 17B, uneven density due to the change in photoconductor sensitivity is first calculated on the basis of the photoconductor rotation period component of uneven density and the photoconductor rotation period component of the light potential (step S41). Then, on the basis of the calculated uneven density, the second image forming condition is calculated (step S42).

Figure 18:
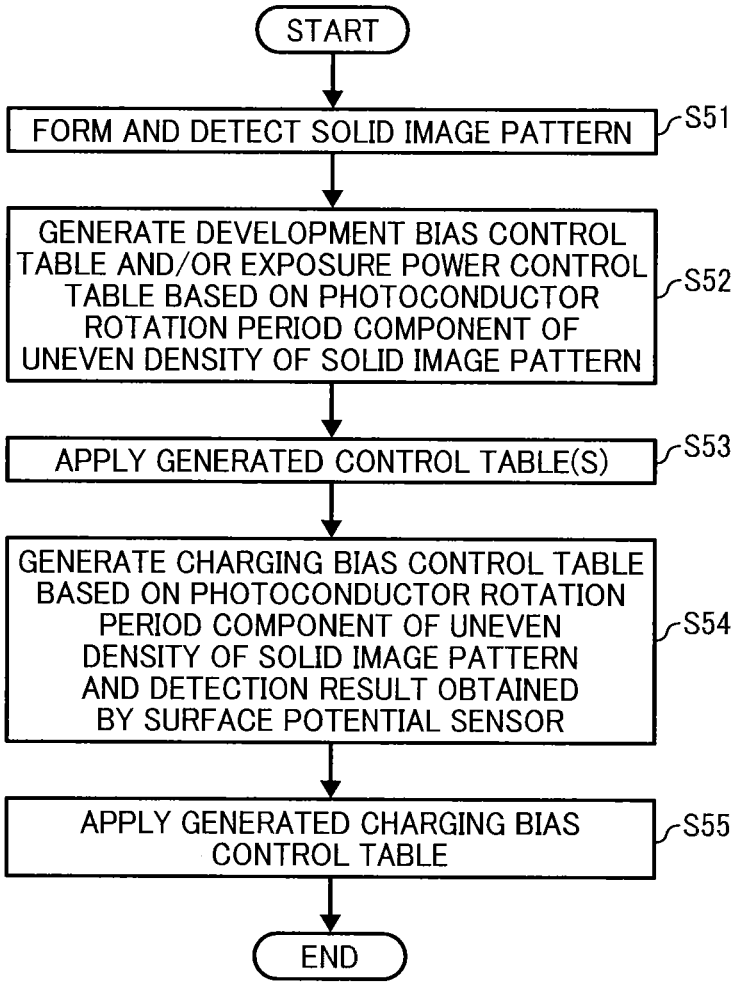
FIG. 18 is a schematic flowchart illustrating still another example of control for suppressing uneven density.

As previously noted, in the present embodiment, the image pattern is a solid image. Further, the first condition is at least one of the development bias (i.e., a development condition of the development device 42) and the exposure power (i.e., an exposure condition of the optical writing unit 38), and the second condition is the charging bias (i.e., a charging condition of the charging device 43). Applied with these parameters, the flowchart of FIG. 15 is rendered as illustrated in FIG. 18.

That is, the solid image pattern serving as the image pattern having a uniform, relatively high density is first formed for each of the colors, and is detected (step S51). In this step, the light potential of the solid image pattern is also detected. Then, on the basis of the photoconductor rotation period component of uneven density of the solid image pattern, at least one of the calculation of the development bias condition (i.e., generation of the control table for controlling the development device 42) and the calculation of the exposure power condition (i.e., generation of the control table for controlling the optical writing unit 38) is performed (step S52). The generated control table for controlling the development device 42 is reflected in the control of the development device 42 by the controller 37 functioning as the first controller, and the generated control table for controlling the optical writing unit 38 is reflected in the control of the optical writing unit 38 by the controller 37 functioning as the first controller (step S53). Then, on the basis of the photoconductor rotation period component of uneven density of the solid image pattern and the photoconductor rotation period component of the light potential, the calculation of the charging bias condition (i.e., generation of the control table for controlling the charging device 43) is performed (step S54). The generated control table is reflected in the control of the charging device 43 by the controller 37 functioning as the second controller (step S55). The flowchart illustrated in FIG. 16 may be similarly applied with the above-described parameters.

The above-described processing may be repeated multiple times. That is, the image forming apparatus 10 may perform image formation by operating the development device 42 and the charging device 43 in accordance with the determined first and second conditions to form an image pattern, cause the toner adhesion amount sensor 52 to detect the density of the image pattern, redetermine the first and second conditions on the basis of the detection result, and form an image based on specification by a user in accordance with the redetermined first and second conditions.

In the installation of the present control into the image forming apparatus 10, the gains for generating the control tables may be set to relatively low values to prevent overcorrection. Therefore, a single execution of the correction control may result in insufficient removal of uneven image density. In this case, the series of processes of the correction control may be repeated to further reduce uneven density. The processes of the correction control may be repeated once or multiple times. Repeated formation of the image pattern, however, is disadvantageous in terms of control time and toner yield. It is therefore preferable that the gains are set to values providing the control effect with a single execution of the correction control, and that the processes of the correction control are completed without reiteration.

The controller 37 stores, in at least one of the nonvolatile memory and the volatile memory thereof, an image forming program serving as an image density control program for executing an image density control method included in an image forming method. The image forming method forms an image with the use of the toner adhesion amount sensor 52, the surface potential sensor 56, the development device 42, and the charging device 43. Specifically, the image forming method operates the development device 42 in accordance with the first condition of the development condition, and operates the charging device 43 in accordance with the second condition of the charging condition. Herein, the toner adhesion amount sensor 52 detects the density of the image formed on the photoconductor 40 with the toner adhering thereto, and the surface potential sensor 56 detects the surface potential of the photoconductor 40 before the toner adheres thereto. Further, the development device 42 is capable of adjusting the density of the image by using the development condition for forming an image, and the charging device 43 is capable of adjusting the density of the image by using the charging condition for forming an image. The controller 37 functioning as the first image forming condition determining device determines the first condition of the development condition to adjust the density of the image, on the basis of uneven density of the image having a length corresponding to at least the circumferential length of the photoconductor 40, which is detected by the toner adhesion amount sensor 52. Further, the controller 37 functioning as the second image forming condition determining device determines the second condition of the charging condition to adjust the density of the image, on the basis of uneven density and the potential distribution of the surface potential over at least the circumferential length of the photoconductor 40, which is detected by the surface potential sensor 56.

At least one of the nonvolatile memory and the volatile memory of the controller 37 storing the above-described image forming program functions as an image forming program storage device. The image forming program is storable not only in the nonvolatile memory and the volatile memory of the controller 37, but also in semiconductor media such as random access memory (RAM) and nonvolatile semiconductor memory, optical media such as digital versatile disc (DVD), magneto-optical (MO) disc, mini disc (MD), and compact disc recordable (CD-R), magnetic media such as hard disk, magnetic tape, and flexible disc, and other storage media. Any of the above-described memories and storage media storing the image forming program forms a computer-readable recording medium storing the program.

It is to be noted that the present invention is not limited to the above-described embodiments. For example, the present invention is applicable to an image forming apparatus such as a copier, a printer, a facsimile machine, a plotter, a color digital multifunction machine capable of forming full-color images by combining at least two of the functions of these apparatuses, and a multifunction machine combining at least two of the functions of the apparatuses (e.g., combination of a copier and a printer). In accordance with a demand from the market in recent years, image forming apparatuses capable of forming color images, such as color copiers and color printers, have been increasing. The present invention, however, is also applicable to image forming apparatuses which only form monochromatic images.

Preferably, an image forming apparatus according to an embodiment of the present invention is capable of forming an image on a sheet-shaped recording medium (also referred to as a recording material, a recording sheet, or a transfer sheet, for example) including not only plain paper commonly used for copying but also an overhead projector (OHP) sheet, a relatively thick sheet such as a card and a postcard, and an envelope, for example. Further, the image forming apparatus also includes a duplex image forming apparatus capable of forming images on both surfaces of the recording medium. Further, the developer used in the image forming apparatus is not limited to the two-component developer, and may be a one-component developer.

The above-described embodiments and effects thereof are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferable. It is therefore to be understood that, within the scope of the appended claims, the disclosure of the present invention may be practiced otherwise than as specifically described herein.

What is claimed is:

1. An image forming apparatus comprising:

a rotatable image carrier configured to carry an image formed thereon with a toner adhering thereto, the image having a length corresponding to at least a circumferential length of the image carrier;

an image density detector configured to detect a density of the image;

a potential detector configured to detect, over at least the circumferential length of the image carrier, a surface potential of the image carrier before the toner adheres thereto;

a first image forming device configured to adjust the density by using a first factor for forming an image, and form an image in accordance with a first condition of the first factor;

a second image forming device configured to adjust the density by using a second factor for forming an image, and form an image in accordance with a second condition of the second factor;

a first image forming condition determining device configured to determine, on a basis of uneven density detected by the image density detector, the first condition of the first factor to adjust the density; and a second image forming condition determining device configured to determine, on the basis of uneven density and a potential distribution of the surface potential detected by the potential detector, the second condition of the second factor to adjust the density.

2. The image forming apparatus according to claim 1, wherein the second image forming condition determining device determines the second condition such that, in an image lower in density than the image having the density detected by the image density detector, uneven density is more suppressed than in the image having the density detected by the image density detector.

3. The image forming apparatus according to claim 1, wherein the second image forming condition determining device extracts, from the potential distribution, uneven density attributed to an image density fluctuation component, and determines the second condition such that the extracted uneven density is suppressed.

4. The image forming apparatus according to claim 1, wherein the second image forming condition determining device determines the second condition on a basis of the potential distribution and influence exerted on the density by the first condition determined by the first image forming condition determining device on the basis of uneven density.

5. The image forming apparatus according to claim 1, wherein the first image forming condition determining device determines the first condition on the basis of uneven density such that a component of the uneven density attributable to at least a development gap fluctuation component is suppressed.

6. The image forming apparatus according to claim 1, wherein the image having the density detected by the image density detector that determines the first and second conditions, is formed under constant image forming conditions.

7. The image forming apparatus according to claim 1, wherein the first image forming device includes at least one of a development device and an exposure device.

8. The image forming apparatus according to claim 1, wherein the second image forming device includes a charging device.

9. The image forming apparatus according to claim 1, wherein an image forming operation is performed to form the image having the density detected by the image density detector, and the first and second conditions are redetermined on a basis of the detected density to perform the image forming operation in accordance with the redetermined first and second conditions.

10. The image forming apparatus according to claim 1, further comprising:

a rotational position detector configured to detect a rotational position of the image carrier, wherein the determination of the first condition by the first image forming condition determining device, the determination of the second condition by the second image forming condition determining device, an operation of the first image forming device according to the first condition, and an operation of the second image forming device according to the second condition are performed in synchronization with the rotational position detected by the rotational position detector.

11. The image forming apparatus according to claim 1, further comprising:

a rotational position detector configured to detect a rotational position of the image carrier, wherein an image forming operation for the determination of the first condition by the first image forming condition determining device and the determination of the second condition by the second image forming condition determining device is performed on a basis of the rotational position detected by the rotational position detector.

12. The image forming apparatus according to claim 1, wherein the first and second conditions are determined at least one of when a number of image forming operations reaches a predetermined number, when a change in rotational position of the image carrier is expected, and when an environmental condition inside the image forming apparatus changes.

13. An image forming method comprising:

forming, on a rotatable image carrier, an image with a toner adhering thereto, the image having a length corresponding to at least a circumferential length of the image carrier;

detecting a density of the image;

determining, on a basis of uneven density detected, a first condition of a first factor for forming an image;

detecting, over at least the circumferential length of the image carrier, a surface potential of the image carrier before the toner adheres thereto;

determining, on a basis of uneven density and a potential distribution of the surface potential, a second condition of a second factor for forming an image; and adjusting the density with the first and second factors, and forming an image in accordance with the first and second conditions.

* * * * *